US009272564B2

(12) United States Patent
Whiteman

(10) Patent No.: US 9,272,564 B2
(45) Date of Patent: Mar. 1, 2016

(54) PHOTONIC CRYSTAL SECURITY DEVICE AND METHOD

(75) Inventor: Robert Whiteman, Reading (GB)

(73) Assignee: DE LA RUE INTERNATIONAL LIMITED, Basingstoke (GB)

( * ) Notice: Subject to any disclaimer, the term of this patent is extended or adjusted under 35 U.S.C. 154(b) by 851 days.

(21) Appl. No.: 12/734,095

(22) PCT Filed: Oct. 14, 2008

(86) PCT No.: PCT/GB2008/003486
§ 371 (c)(1),
(2), (4) Date: Apr. 19, 2010

(87) PCT Pub. No.: WO2009/050448
PCT Pub. Date: Apr. 23, 2009

(65) Prior Publication Data

US 2010/0253061 A1 Oct. 7, 2010

(30) Foreign Application Priority Data

Oct. 19, 2007 (GB) ..... 0720550.3

(51) Int. Cl.
*B42D 15/00* (2006.01)
*B42D 15/10* (2006.01)
(Continued)

(52) U.S. Cl.
CPC ..... *B42D 25/425* (2014.10); *B42D 25/00* (2014.10); *B42D 25/29* (2014.10); *B42D 25/328* (2014.10);
(Continued)

(58) Field of Classification Search
CPC ..... B42D 25/425; B42D 25/29; B42D 25/00; B42D 25/387; B42D 25/328; B42D 25/382; B42D 2033/16; B42D 2035/14; B42D 2033/10; B42D 2033/08; B42D 2033/32; B42D 2035/24
USPC ..... 283/72, 87, 88, 89, 91, 94, 98, 100, 111
See application file for complete search history.

(56) References Cited

U.S. PATENT DOCUMENTS 1,996,539 A 4/1935 Dufay
4,186,943 A 2/1980 Lee
(Continued)

FOREIGN PATENT DOCUMENTS

EP 0 059 056 A1 9/1982
EP 0 435 029 A2 7/1991
(Continued)

OTHER PUBLICATIONS

Ruhl et al., "Artificial opals prepared by melt compression," *Polymer*, vol. 44, 2003, pp. 7625-7634.
(Continued)

*Primary Examiner* — Alexander P Taousakis
*Assistant Examiner* — Justin V Lewis
(74) *Attorney, Agent, or Firm* — Oliff PLC

(57) ABSTRACT

A method of forming an optically variable security device is provided. In the method, a photonic crystal material is provided and a process is performed upon the material which causes deformation of the material so as to form a first region (A) for which incident light received by the crystal material is selectively reflected or transmitted to generate a first optically variable effect, and a second region (B) for which incident light received generates an optical effect, different from the first optically variable effect. Corresponding devices having first and second regions are also disclosed.

47 Claims, 13 Drawing Sheets

(51) Int. Cl.

| | |
|---|---|
| ***B42D 25/425*** | (2014.01) |
| ***B42D 25/29*** | (2014.01) |
| ***B42D 25/00*** | (2014.01) |
| *B42D 25/328* | (2014.01) |
| *B42D 25/382* | (2014.01) |
| *B42D 25/387* | (2014.01) |

(52) U.S. Cl.

CPC ..... *B42D 25/382* (2014.10); *B42D 25/387* (2014.10); *B42D 2033/08* (2013.01); *B42D 2033/10* (2013.01); *B42D 2033/16* (2013.01); *B42D 2033/20* (2013.01); *B42D 2033/32* (2013.01); *B42D 2035/14* (2013.01); *B42D 2035/16* (2013.01); *B42D 2035/24* (2013.01); *B42D 2035/36* (2013.01)

(56) References Cited

U.S. PATENT DOCUMENTS

| | | | | |
|---|---|---|---|---|
| 6,337,131 | B1 | 1/2002 | Rupaner et al. | |
| 2004/0131799 | A1 | 7/2004 | Arsenault et al. | |
| 2004/0253443 | A1 | 12/2004 | Anselmann et al. | |
| 2005/0029800 | A1 | 2/2005 | Disano et al. | |
| 2005/0228072 | A1 | 10/2005 | Winkler et al. | |
| 2006/0133431 | A1 * | 6/2006 | Payne et al. | 372/6 |
| 2007/0178307 | A1 | 8/2007 | Winkler et al. | |
| 2007/0269725 | A1 * | 11/2007 | Steenblik et al. | 430/5 |

FOREIGN PATENT DOCUMENTS

| | | | |
|---|---|---|---|
| EP | 0 860 298 | A2 | 8/1998 |
| EP | 1 398 174 | A1 | 3/2004 |
| WO | WO 83/00659 | A1 | 3/1983 |
| WO | WO 90/02658 | A1 | 3/1990 |
| WO | WO 92/11142 | A1 | 7/1992 |
| WO | WO 95/10419 | A1 | 4/1995 |
| WO | WO 95/10420 | A1 | 4/1995 |
| WO | WO 97/19821 | A1 | 6/1997 |
| WO | WO 98/20382 | A1 | 5/1998 |
| WO | WO 98/25236 | A1 | 6/1998 |
| WO | WO 99/28852 | A1 | 6/1999 |
| WO | WO 00/39391 | A1 | 7/2000 |
| WO | WO 00/50249 | A1 | 8/2000 |
| WO | WO 03/054297 | A2 | 7/2003 |
| WO | WO 03/061980 | A1 | 7/2003 |
| WO | WO 03/061983 | A1 | 7/2003 |
| WO | WO 03/062900 | A1 | 7/2003 |
| WO | WO 03062900 | A1 * | 7/2003 |
| WO | WO 03/091952 | A2 | 11/2003 |
| WO | WO 03/091953 | A2 | 11/2003 |
| WO | WO 03/095188 | A2 | 11/2003 |
| WO | WO 2005/080089 | A1 | 9/2005 |
| WO | WO 2006/018094 | A1 | 2/2006 |
| WO | WO 2008/098339 | A1 | 8/2008 |

OTHER PUBLICATIONS

Pursiainen et al., "Nanoparticle-tuned structural color from polymer opals," *Optics Express*, vol. 15, No. 15, Jul. 23, 2007, pp. 9553-9561.

Arsenault et al., "From colour fingerprinting to the control of photoluminescence in classic photonic crystals," *Nature Materials*, vol. 5, Mar. 2006, pp. 179-184.

International Search Report isued for International Application No. PCT/GB2008/003486 on Mar. 27, 2009.

* cited by examiner

PHOTONIC CRYSTAL SECURITY DEVICE AND METHOD

FIELD OF THE INVENTION

The present invention relates to improvements in security devices that can be used in varying shapes and sizes for various authenticating or security applications.

BACKGROUND TO THE INVENTION

Security documents such as banknotes now frequently carry optically variable devices that exhibit an angularly dependent coloured reflection. This has been motivated by the progress in the fields of computer-based desktop publishing and scanning, which renders conventional security print technologies such as intaglio and offset printing more prone to attempts to replicate or mimic. It is well known in the prior art to use liquid crystal materials or thin film interference structures to generate such angularly dependent coloured reflection. Examples of liquid crystal based security devices are described in EP0435029, WO03061980, and EP1156934 and examples of security devices utilising thin film interference structures are described in U.S. Pat. No. 4,186,943 and US20050029800.

The planar nature of liquid crystal films and thin film interference structures results in the observed angularly dependent coloured reflection exhibiting limited spatial variation for example a simple red to green colour change on tilting the security device away from normal incidence.

Photonic crystals are structured optical materials in which the refractive index varies periodically in two or preferably three dimensions. These materials exhibit a range of interesting optical effects when subject to electromagnetic radiation of a wavelength comparable to the spatial modulation of the refractive index. Bragg reflection may occur over a range of wavelengths that depend on the direction of incidence/propagation and the periodicity of refractive index variation. This gives rise to photonic 'energy gaps' that are analogous to the electronic band gaps in semiconductors. Typically, electromagnetic waves within a certain frequency range cannot propagate in particular directions within the crystal, and incident electromagnetic radiation at these wavelengths is consequently reflected. It is the presence of such partial photonic band gaps that gives rise to the shimmering colours observed in opal gemstones.

In general there is a complex dependence on the wavelength, direction of propagation and polarisation that dictates which electromagnetic waves may propagate within the photonic crystal and those that are otherwise reflected. However, if the modulation in refractive index is sufficiently strong, propagation of certain frequencies can be forbidden for any crystalline direction, and a complete photonic band gap arises. In this case light is prevented from propagating within the crystal in any direction, and the material acts as an ideal reflector such that all light of a wavelength within the band gap range is perfectly reflected irrespective of the incident direction.

There exists two well-documented methods of fabricating structures with the necessary highly ordered variation in refractive index—microfabrication and self-assembly. Due to the complexity of microfabrication considerable effort has been devoted to investigating self-assembling systems comprised of submicron three-dimensional arrays of dielectric spheres. Such photonic crystals are formed by allowing a colloidal suspension of identically sized spheres to settle slowly under the influence of gravity or by the application of an external force such that the spheres are encouraged to order. One example is the fabrication of synthetic opal structures where uniformly sized sub-micron silica spheres are organised through a sedimentation process into a face-centred cubic crystal structure.

Further enhancements to this technique have been developed such that the synthetic opal acts as a precursor or template to further customise the structure. It has been shown that it is possible to use such systems as templates to realise materials known as inverse or inverted opals. Here, the regions between the silica spheres are first filled with a suitable matrix material, and the silica is then dissolved by chemical means to give a system that consists of an array of air spheres or voids surrounded by a uniform matrix.

The use of photonic crystals to generate angular dependent coloured reflection is described in WO03062900 and US20050228072. The optical properties of photonic crystals can be engineered and varied to a greater extent than the optical properties of planar liquid crystal and thin film interference devices. Firstly the angular and wavelength dependence of the reflected light can be more easily controlled by varying the crystal lattice structure by either simply adjusting the sphere size, or the sphere separation. Similarly, selected allowed and disallowed reflections/transmissions may be engineered or enhanced by introducing structural defects into the lattice or by introducing nanoparticles into the structure. This in principle gives freedom to modify and engineer the band structure and hence the wavelength and spatial dependence of the reflectivity.

The use of photonic crystals in security devices has been limited and in the prior art their use is limited to a simple angular dependent coloured reflection the authenticator observes by tilting the device. There is also no teaching in the prior art on how to incorporate such devices into security documents such that the additional optical effects possible from photonic crystals, compared to other well known dichroic materials, can be used to validate the document. The object of the current invention is to improve the security of the devices described in the prior art.

SUMMARY OF THE INVENTION

In accordance with a first aspect of the present invention we provide an optically variable security device comprising at least two regions, each region comprising a photonic crystal material whereby in a first region the incident light received by the crystal is selectively reflected or transmitted by the crystal to generate a first optically variable effect and in a second region the incident light received by the crystal is selectively reflected or transmitted by the crystal to generate an optical effect, different from the first optically variable effect.

The optical effect may produce a non-optically variable effect, such as reflection of the incident light at all wavelengths. However, the optical effect generated may also be a second optically variable effect that is different from the first.

Reflected light in the context of the present invention includes both specularly reflected light and scattered light.

Various types of crystals may be used to achieve the present invention, and it should be noted that the term "photonic crystal" is intended to include quasi-crystals that exhibit this effect, as well as more conventional ordered "non-quasi" photonic crystals.

The optical effect of the second region may be formed by varying the materials used for the spheres and/or the matrix from the materials used for the first region or by using the same materials as the first region but locally varying the sphere size.

The optical effect of the second region may be formed by creating regions of disorder in the photonic crystal lattice so as to generate optically variable regions (opalescent) partitioned by non-opalescent regions. The degradation of the crystal order can be achieved in a number of ways including incorporating a wide distribution of sphere sizes in the photonic crystal, incorporating additional materials into the photonic crystal material which locally disrupt the order, and/or creating the photonic crystal material using non-optimal process parameters. Non-opalescent regions may also be created by the application of a pressure to locally disrupt the crystal structure for example by embossing or hot stamping.

Alternatively the photonic crystal lattice may in its initially formed state exhibit "non-optimal" ordering which forms the second region of the security device. Subsequently the first region of the security device is formed by creating regions of enhanced order of the photonic crystal lattice. The enhanced ordering can take place under the application of heat and pressure to a sufficient level that the spheres can undergo shear flow within the matrix but the spheres themselves are not deformed.

The light may comprise visible and/or non-visible light, therefore including for example ultraviolet and infra-red light. Broad or narrow wavelength bands may be used. Likewise, the photonic crystal may be arranged to selectively reflect light in the non-visible part of the spectrum (including ultra-violet and infra-red). When the light is produced by a white light (broad wavelength band) source, preferably the first optically variable effect and second optical effect are colour effects.

Whilst the first and second effects are preferably observed as reflective effects, transmissive effects are also contemplated.

The photonic crystal may be provided in a number of forms, for example as a self-supporting layer. Alternatively, it may be supported by a substrate or carrier layer to which it is mounted directly or indirectly (through one or more further layers). The substrate or the carrier layer may take the form of a polymeric layer.

The security device may also comprise one or more further adhesive layers, for example, for bonding the device to a further device and/or security document. Typically one or more of such adhesive layers are provided upon an outer surface of the device.

The optically variable security device may further comprise an optically absorbent material provided as one or more layers applied to the device. Such a layer may be provided upon the photonic crystal or indeed the material may be formed within the crystal structure itself. A combination of these is also contemplated. The inclusion of such an absorbent material can be used to enhance the optical effect to an observer, or used to modify the optical effect by the use of for example absorbent materials that are selectively absorbent at the wavelengths of light used. In some examples dyes or inks are used for this purpose.

The optical properties may also be additionally or alternatively further modified or enhanced by the use of nanoparticles positioned within the crystal structure, preferably at interstitial sites. The nanoparticles may be distributed substantially uniformly through the crystal such that each part of the crystal exhibits substantially the same optical effect. Alternatively the nanoparticles may be distributed inhomogeneously through the crystal such that different parts of the crystal exhibit a substantially different optical effect. Thus the nanoparticles may be distributed according to a concentration gradient. The nanoparticles may also be distributed in a number of regions having different concentrations.

The optically variable security device may further comprise a metallised layer. Preferably such a layer is selectively demetallised at a number of locations. In addition the device may further comprise a layer of resist upon the metallised layer. The metallised layer and/or the layer of resist is preferably arranged as indicia. Such layers with or without indicia may be visible from the same side of the photonic crystal that receives the light, or from the reverse side. Transmissive viewing of the layers is also contemplated.

It is also preferred that the device is arranged to be machine-readable. This may be achieved in a number of ways. For example at least one layer of the device (optionally as a separate layer) or the photonic crystal itself may further comprise machine-readable material. Preferably the machine-readable material is a magnetic material, such as magnetite. The machine-readable material may be responsive to an external stimulus. Furthermore, when the machine-readable material is formed into a layer, this layer may be transparent.

The optically variable security device may be used in many different applications, for example by attachment to objects of value. Preferably, the security devices are adhered to or substantially contained within a security document. Such security documents include banknotes, cheques, passports, identity cards, certificates of authenticity, fiscal stamps and other documents for securing value or personal identity.

The security device may therefore be attached to a surface of such a document or it may be embedded within the document so as to provide crystal surfaces for receiving incident light on one or each of opposing faces of the document. The security device may take various different forms for use with security documents, these including a security thread, a security fibre, a security patch, a security strip, a security stripe or a security foil as non-limiting examples.

Polymeric based photonic crystal materials are particularly suitable for the current invention and would typically comprise polymeric materials for both the matrix and the spheres. Typical examples of polymeric photonic crystals suitable for the current invention are described in US20040131799, US20050228072, US20040253443 and U.S. Pat. No. 6,337,131. The crystal may be formed from spheres of the first material and a matrix of a second material wherein each material has a different respective refractive index.

Materials suitable for forming the spheres are preferably single polymer or copolymer materials. Typical examples include both polymers and copolymers of polymerisable unsaturated monomers and polycondensates and copolycondensates of monomers containing at least two reactive groups, such as, for example, high-molecular-weight aliphatic, aliphatic/aromatic or fully aromatic polyesters, polyamides, polycarbonates, polyureas and polyurethanes, but also amino and phenolic resins, such as, for example, melamine-formaldehyde, urea-formaldehyde and phenol-formaldehyde condensates, are suitable.

Materials suitable for forming the matrix include addition polymers and copolymers of polymerisable unsaturated monomers and also of the polycondensates and copolycondensates of monomers having two or more reactive groups, e.g., high molecular weight aliphatic, aliphatic-aromatic or wholly aromatic polyesters and polyamides, but also of the amino and phenolic resins, such as melamine-formaldehyde, urea-formaldehyde and phenol-formaldehyde condensates.

Photonic crystals that can be more easily formed into films typically comprise polymeric materials for both the matrix and the spheres. The polymers for both the matrix and the spheres may be selected to maximise the refractive index difference. The refractive index difference should be at least 0.001, but more preferably greater than 0.01 and even more preferably greater than 0.1.

Non-polymeric materials are also envisaged for the spheres and the matrix and they may be inorganic or metallic or a hybrid composite.

The two contrasting regions of the photonic crystal layer can be created by modifying the characteristics of the photonic crystal lattice. The presence of a full or partial photonic band gap, resulting in the exclusion of certain wavelengths for specific directions of incidence/propagation, arises from the difference in refractive index between the matrix and the spheres forming the photonic crystal. Increasing the difference in refractive index between the spheres and the matrix increases the intensity of the observed colours and colour-shifts and increases the number of directions of incidence propagation over which a specific wavelength is excluded.

Two contrasting coloursifting regions can be achieved by using different materials for the spheres and/or the matrix for the two regions of the photonic crystal layer and thereby changing the difference in the refractive index and the observed optically variable effect.

The optical properties of the photonic crystal layer can also be modified by changing the crystal structure, the crystal spacing or the size of the spheres in localised regions of the security device.

A specific example of polymeric materials that can be used to produce an elastic photonic crystal material suitable for use in the current invention consists of spheres of crosslinked polystyrene in an polyethylacrylate matrix. A polymethylmethacrylate interlayer is present between the spheres and the matrix to ensure compatibility. The elastic photonic crystal material produced exhibits a face-centred-cubic crystalline structure with the (111) plane parallel to the surface of the film. For the specific example discussed above Ruhl et al, in Polymer 44 (2003) 7625-7634, have shown that the polystyrene sphere diameter can be varied between 150 and 300 nm to produce films of different colours when viewed at normal incidence without the application of an external stimulus. For example when viewing at normal incidence the colour varies with the sphere size as follows:

| Sphere Size (nm) | Colour observed at normal incidence |
|---|---|
| 207 | Blue |
| 249 | Green |
| 259 | Yellow |
| 282 | Red |

As a general guide, irrespective of the polymer type, the particle size of the spheres is preferably in the range 50-500 nm, and even more preferably in the range 100-500 nm, in order for the crystal to reflect light in the visible region of the electromagnetic spectrum. Two contrasting optically variable regions can be achieved by forming different regions of the photonic crystal layer using different sphere sizes. Alternatively in one region the sphere size can be sufficiently large to disrupt the crystal order such that in this region the material is non-opalescent, i.e. non-optically variable.

Preferably the photonic crystal material for use in the current invention is in the form of a film. Production methods for forming polymeric films of photonic crystal materials are known in the art. For example films can be made using standard polymer continuous processing techniques such as rolling, calendaring, film blowing or flat-film extrusion as detailed in US20050228072 and US20070178307. In this process the alignment of the spheres occurs under the mechanical shear force applied by the film forming process. Once the film is formed the matrix is cooled and/or cross-linked, depending on the polymer system, to fix the orientation of the spheres.

The different regions of photonic crystal material may be created during the film formation process. Preferably the creation of the two regions takes place during a continuous process. In one preferred embodiment the polymeric photonic crystal film is produced by an extrusion process. In this case longitudinal laterally spaced bands of polymer resins, comprising different sphere and/or matrix combinations can be achieved by providing a set of dividers in the polymer reservoir so that the different polymer resins are supplied through the extruder at corresponding lateral positions. Alternatively transverse laterally spaced bands can be achieved by changing the polymeric resin during the process.

In one embodiment the sphere size in the polymer resin may be varied gradually along the film to produce a graduated change in optical properties or the change in sphere size may be stepped to produce a sharp transition in optical properties.

It is common and well known that a degree of drag or stick can occur in extrusion of polymer films and in the current invention this drag can be controlled to form one of the regions of the device. One way of increasing the drag is to create textured regions on the extrusion die which creates a different optical effect, either opalescent or non-opalescent, compared to the regions of the film not in contact with the textured regions. Preferably the textured pattern is aligned in the direction of the extrusion. The scale of the texture is not limited and can be diffractive in nature (structures with dimensions of <10 μm) or non-diffractive in nature (structures with dimensions above 10 μm). One example of non-diffractive structures are micro-optical structures and include geometric shapes based on prisms, domes, hemispheres, hexagons, squares, cones, stepped structures, cubes, or combinations thereof. Alternatively the non-diffractive structures could comprise images formed from coarse line structures with dimensions preferably in the range 100-1000 μm.

Alternatively the degree of drag through the extrusion die can be modified by the use of slip improving additives such as waxes. Such slip additives can be added to the polymer reservoir prior to extrusion. The slip additives can be applied in bands by providing a set of dividers in the polymer reservoir so that the slip additives are supplied through the extruder at corresponding lateral positions and therefore differential optical effects can be achieved in the resultant polymer film due to the differential slip through the die.

If the photonic crystal material is in the form of a polymeric film produced on a continuous or semi-continuous process such as one or a combination of extrusion, film blowing, uniaxial pressing, rolling or calendaring, then the photonic crystal structure formed may be varied by varying the process conditions during the production run. The polymer photonic crystal is formed through the application of a mechanical shear force to the core/shell particles. For example the level of force may be varied in a controlled manner during the production process such that the photonic crystal structure is changed to produce different optical effects. In one embodiment the force is set to an optimum level by experimentation such that a strong optically variable effect is observed in the form of an intense angular dependent colour variation. At controlled points in the process the level of force is changed to a non-optimum level such that a degree of disorder is introduced into the crystal structure. In the regions experiencing the non-optimum level of force the photonic crystal will either be no longer opalescent and will not therefore exhibit an angular dependent coloured reflection or only be weakly opalescent. In this manner a photonic crystal film can be created with optically variable regions partitioned by substantially non-opalescent regions. In addition to the level of force the temperature of the polymer resin during the application of the force and the rate of cooling once the film is formed can also be varied, away from the optimum conditions, to produce regions within the film with different optical effects.

In accordance with a second aspect of the present invention we provide a method of forming an optically variable security device, comprising:— providing a photonic crystal material; and, performing a process upon the material which causes deformation of the material so as to form a first region for which incident light received by the crystal material is selectively reflected or transmitted to generate a first optically variable effect, and a second region for which incident light received generates an optical effect, different from the first optically variable effect.

The first region may preferably comprise an opal-like structure or an inverse opal-like structure. An opal-like structure can be defined as composed of substantially spherical particles of substantially the same size, that are arranged in a close-packed (such as face-centered-cubic) arrangement. The refractive index of the particles is distinct from the surrounding matrix of solid, liquid or gas, and the dimensions of particles are of the order of the wavelength of the light. An inverse opal-like structure can therefore be defined as an analogous structure in which the refractive index of the articles is less than that of the surrounding matrix.

When the inverse opal-like structure is present in the first region, the optical effect generated by the second region may be a non-opalescent effect. In some cases the second region may also have an inverse opal-like structure, which is different from the structure of the first region. Whilst the photonic material may have an opal-like form prior to the application of the deformation process, in some situations an inverse opal-like form may be used prior to the process being performed. This may be formed using a sedimentation (template) process and may be provided in the form of a film for subsequent application of the deformation process.

In many cases the photonic crystal material comprises a number of objects of similar geometry, formed from a first material, located within a matrix of a second material, different from the first. Typically the process in this case comprises performing a first process upon the material in which the material is subject to a deformation so as to form one of a first and second region of the material; and, performing a second process upon the material so as to form the other of a first and second region of the material, wherein the first region of the material causes incident light received by the crystal material to be selectively reflected or transmitted to generate a first optically variable effect, and the second region generates an optical effect, different from the first optically variable effect.

This is particularly advantageous in that the combination of two processes, at least one of which includes deformation, provides the formation of first and second regions, the first of which at least exhibits an optically variable effect. Whilst in principal a number of different materials and object shapes may be used to implement the invention, preferably for the second aspect, the objects are spheres formed from a first polymer and the matrix comprises a second polymer, different from the first polymer. We note here also that the references to first and second processes herein does not necessarily denote a timing sequence relating to the processes, since the second may be performed before the first in some cases.

The methods of the second aspect of the invention may of course be used in the formation of devices in accordance with the first aspect of the invention.

It is contemplated by the invention that the opal-like structure (or indeed the inverse opal-like structure where appropriate) may not be perfect and therefore may include short range order only. As such it may be non-optimal. The degree or extent of ordering controls the strength of the photonic effects and therefore any optically variable effect. Thus the ordering is at least approximate when it is sufficient to cause a detectable optically variable response, either by machine readable means or to the human eye. The first region of the material typically has an at least approximately opal-like structure. The first region may be formed as a result of the first process. For example, the first process may be sufficient to cause the objects to move relative to one another within the matrix so as to form an at least partially ordered structure.

However, in some situations it may be that the first process of deformation is insufficient to generate an opalescent effect and therefore the first process results in the second region. A further deformation may be required as part of the second process to produce the optically variable effect of the first region in this case. In such an example the photonic crystal film may be formed by a flat film extrusion process such that the ordering of the photonic crystal is non-optimal and a non-opalescent effect is observed. The photonic crystal film then undergoes a further mechanical force in localised regions, in the form of a shear force, at increased temperatures to enhance the ordering and create opalescent regions. In this manner a photonic crystal film can be created with optically variable regions partitioned by non-opalescent regions.

In other cases, the first process may result in sufficient ordering of the structure such that at least an opal-like structure is formed. In this case the second process may result in a further increase in the ordering. It is also possible that some degree of disordering may occur which nevertheless results in each region having an opal-like structure. One or each of these regions may be processed further to provide an inverse structure if required, using the techniques described later, such as by a dissolution process. It will be appreciated therefore that in many implementations, the optical effect of the second region is a second optically variable effect.

The second process may be used to increase the degree of disorder in part of the material. Thus, the second process may be a deformation process which causes the objects to be displaced from the second region so as to disorder the material in the second region. The second process may alternatively be a deformation process which causes permanent deformation to the objects so as to disorder the material in the second region.

Typically one or each of the first and second processes includes a heat treatment. The first process may be performed at a temperature in excess of a glass transition temperature of the second material so as to allow mobility of the first material objects within the matrix. The application of the shear force (deformation) should take place at a temperature which enables the spheres to undergo shear flow within the matrix but without the objects themselves such as spheres being deformed. For a polymer photonic crystal material this temperature should preferably be at least 40° above the glass transition of the polymer matrix and more preferably above 60°. There are various mechanisms by which the first process may apply a deformation in the form of a shear force, these typically comprising at least one of extrusion, stamping, rolling or calendaring. A combination of these methods is contemplated in the use of a multistage process. When an extrusion process is used, the deformation of the material may be controlled by the selective addition of a slip-improving additive to at least a part of the photonic crystal material, or by the formation of a texture on the extrusion die surfaces.

It is preferred that the first process results in the photonic crystal being formed into a film. A typical thickness such a film is less than 100 micrometers, preferably less than 50 micrometers.

The second process may also apply a deformation to the photonic crystal material using at least one of the processes selected from extrusion, stamping, rolling or calendaring. Again a multi-stage process can be used. Where the objective of the second process is to cause disordering, the process may be performed at a temperature in excess of a glass transition temperature of the first material (the glass transition temperature of the first material in any case being preferably higher than that of the second material). Such a treatment temperature may also be in excess of the melting point of the first material.

Where an opal-like structure is formed according to any of the methods described above, the method may further comprise removing the objects of the first material from the photonic crystal material when arranged in an opal-like structure, so as to form an inverse opal-like structure. This may be achieved with the use of a suitable solvent for the first material which is not a solvent for the second material. A variety of processes may be used to achieve this, including one or more of immersing the material in a bath of solvent or printing the solvent onto the photonic crystal material. It is also contemplated that such a process of forming an inverse opal-like structure may be desirable for only a selected part of the respective region. Whereas in some cases localised techniques may be used to apply the solvent, preferably a desired area of the material is protected by the application of a mask. Having formed an opal-like structure either selectively or within an entire region, the method may further comprise applying a further deformation process to part of that inverse opal-like structure.

The application of the deforming or structure enhancing force can take place either before or after the photonic crystal film has been fully cured or cross-linked. For example the film can undergo a hot stamping or embossing operation. This can be part of a continuous operation in line with the film forming process or carried out off-line in a separate process. The deforming or structure enhancing force may be applied after the security device, comprising the photonic crystal film, has been applied to the secure document it is protecting. Preferably the applied force creates a design of opalescent regions in a non-opalescent background.

It will be appreciated from the discussion above that a number of different regions of the photonic crystal material may be formed having different optical effects. It is preferred that one or more of these regions are shaped as indicia.

Having formed a suitable security device from the photonic crystal, the method preferably further comprises adhering the material to, or containing the material within, a security document.

Other methods of forming devices according to the first aspect are envisaged. For example, non-opalescent regions of the photonic crystal material can also be generated by the controlled incorporation of additives, which disrupt the photonic crystal structure, into the polymer mix. For example in a continuous extrusion process the additive could be added to the polymer reservoir at timed intervals to generate transverse non-opalescent bands or the additive could be added in localised regions using dividers in the polymer reservoir and thereby creating longitudinal non-opalescent bands in the resultant film.

Alternatively a film of photonic crystal material can be made by applying a coating composition comprising the spheres and matrix to a carrier film as described in U.S. Pat. No. 6,337,131. Once the coating composition has been applied any dispersing or diluting material is removed and the spheres orientate via a settling process following which the matrix is cross-linked to fix the orientation of spheres. In one embodiment of the current invention two different coating compositions are printed onto a carrier film in register to create first and second regions of different photonic crystal materials exhibiting different optically variable and/or optical effects.

Alternatively the photonic crystal material can be used in a powder or pigmented form. The pigments are obtained by forming a film on a carrier layer, detaching the film and grinding it up into a pigment or powder. As with previous embodiments different photonic crystal materials, exhibiting different optical effects can be generated and then printed onto a base substrate or carrier film. The advantage of a pigmented system is that the material can be printed directly onto a secure document such as a polymer or paper banknote.

An example security device fabricated according to the second aspect of the invention comprises at least two regions that are characterised by different photonic crystal structures. The first crystal structure has an 'opal' structure and is formed by a regular three dimensional array of solid, submicron spheres surrounded by a matrix material of a different refractive index. The second structure, commonly referred to as an 'inverse opal' structure, is composed of a regular array of voids surrounded by a continuous matrix material. Both structures exhibit the phenomenon known as structural colour whereby their visual appearance is a function of their configuration; in particular the arrangement, size and refractive index (relative to the matrix) of the spheres or voids.

A security feature composed of two such photonic crystal structures will result in distinct regions of different visual appearance and/or different optically variability. For example, different colours in reflection or transmission, different colour shifts, or different rates of colour shift away from a base colour.

Furthermore, the two types of structure will have different physical/mechanical properties. Due to the 'sponge-like' nature of the inverse opal it may be more readily compressed. Compressing such a material distorts the periodicity of the structure and consequently can affect a change in the visual appearance. As a result, regions composed of an inverse structure will show greater optical variability as a function of compression compared to those composed of a standard opal-like structure. This may be assisted by the use of an elastomeric matrix material, which naturally gives a more flexible system.

Using an elastomer as the matrix for standard opal-like structures generally means that analogous changes in the optical properties can be achieved by stretching the system. Hence in one embodiment a security device comprises two regions, one of the standard opal-like structure and one of the inverse opal-like structure; one region giving a dominant optical effect when compressed and the other giving a dominant optical effect when stretched.

One further advantage of such a feature is the possibility of deriving one region (the inverse opal) from the other (the opal). This will involve post-processing a continuous opal-like structure, for example using the techniques discussed earlier, to convert a selected region to an inverse opal-like structure. In other words, a security device could be made by 'patterning' and converting regions of standard opal-like structure to ultimately give two type of crystal structure.

In practice, most inverse opal-like structures are achieved by first fabricating a standard opal and then selectively removing the submicron spheres by a selective etching process that leaves the matrix material unaffected. If a security device were made form a suitable material system it would be possible to etch out the spheres in chosen regions whilst leaving other areas unaltered. The resultant feature would have a continuous matrix whilst having distinct opal-like and inverse opal-like regions.

Suitable materials for use in inverse opal structures are disclosed in WO2008098339. The inverse opal-like film can be generated using a template, in one example the template is formed by using self-assembly techniques to order polystyrene spheres on a glass substrate. The voids between the polystyrene spheres are then filled with a polymer material. Examples of suitable polymer materials are listed in WO2008098339 and include a monomer or pre-polymer selected from the group consisting of methacrylic acid esters, acrylic acid esters, polyisoprene, polybutadiene, polyurethane precursors, crosslinkable polyethers, and mixtures thereof. The polystyrene is then dissolved by an appropriate solvent in localised regions of the inverse opal-like film to give a material that in a first region consists of air spheres separated by a uniform matrix of the polymeric material and in a second region consists of polystyrene spheres surrounded by the uniform matrix of the polymeric material. More information on the selection of an appropriate solvent to dissolve polymer microspheres can be found in "An Introduction to Polymer Colloids", 1$^{st}$ Edition, published by Springer in December 1989. It is particularly important for the second "opal" regions that the polymers for both the matrix and the spheres are selected to maximise the refractive index difference. The refractive index difference should be at least 0.001, but more preferably greater than 0.01 and even more preferably greater than 0.1.

A further advantage of adding inverse regions to an area of standard opal-like structure is that the additional porous regions will be sensitive to absorption of water and other liquids. This offers an additional means of authentication, whereby a colour change can be affected by exposing the system to a appropriate liquid.

The security device could be arranged either wholly on the surface of the document, as in the case of a stripe or patch, or may be visible only partly on the surface of the document in the form of a windowed security thread. The photonic crystal material is preferably incorporated into the device structure as a film but alternatively it may be incorporated as a pigmented coating.

The security device may include other additional security features or the device may be overlaid over an additional security feature, one example of which is the selectively demetallised layer discussed above, in order to provide enhanced security. The security device may also be supported upon a transparent layer, for example to allow the surface contacted by the transparent layer to receive or transmit light.

Security threads are now present in many of the world's currencies as well as vouchers, passports, travellers' cheques and other documents. In many cases the thread is provided in a partially embedded or windowed fashion where the thread appears to weave in and out of the paper. One method for producing paper with so-called windowed threads can be found in EP0059056. EP0860298 and WO03095188 describe different approaches for the embedding of wider partially exposed threads into a paper substrate. Wide threads, typically with a width of 2-6 mm, are particularly useful as the additional exposed area allows for better use of optically variable devices such as the current invention.

The device could be incorporated into the document such that regions of the device are viewable from both sides of the document. Techniques are known in the art for forming transparent regions in both paper and polymer substrates. For example, WO 8300659 describes a polymer banknote formed from a transparent substrate comprising an opacifying coating on both sides of the substrate. The opacifying coating is omitted in localised regions on both sides of the substrate to form a transparent region. In one embodiment the transparent substrate of the polymer banknote also forms the carrier substrate of the security device.

Alternatively the security device of the current invention could be incorporated in a polymer banknote such that it is only visible from one side of the substrate. In this case the security device is applied to the transparent polymeric substrate and on one side of the substrate the opacifying coating is omitted to enable the security device to be viewed while on the other side of the substrate the opacifying coating is applied over the security device such that it conceals the security device.

Methods for incorporating a security device such that it is viewable from both sides of a paper document are described in EP1141480 and WO03054297. In the method described in EP1141480 one side of the device is wholly exposed at one surface of the document in which it is partially embedded, and partially exposed in windows at the other surface of the substrate.

In the case of a stripe or patch the photonic crystal film is preferably prefabricated on a carrier substrate and transferred to the substrate in a subsequent working step. The photonic crystal film can be applied to the document using an adhesive layer. The adhesive layer is applied either to the photonic crystal film or the surface of the secure document to which the device is to be applied. After transfer the carrier strip can be removed leaving the photonic crystal film device as the exposed layer or alternatively the carrier layer can remain as part of the structure acting as an outer protective layer.

Following the application of the photonic crystal device the document, such as a banknote, undergoes further standard security printing processes including one or more of the following; wet or dry lithographic printing, intaglio printing, letterpress printing, flexographic printing, screen-printing, and/or gravure printing. In a preferred example and to increase the effectiveness of the security device against counterfeiting the design of the security device should be linked to the document it is protecting by content and registration to the designs and identifying information provided on the document.

Furthermore the photonic crystal device may be customised by overprinting or embossing either before or after it is incorporated into the security document. The embossing may comprise a coarse non-diffractive embossing or a diffractive embossing. The device may be arranged to produce a latent image which is selectively visible according to the viewing angle. The surface of the photonic crystal may be directly embossed to produce raised structures which can be used to form a latent image. Furthermore the device may be arranged to comprise a hologram, optionally using an embossed structure on the photonic crystal surface, or by providing a diffractive structure in a further metallic layer which may partially overlay the crystal for example.

BRIEF DESCRIPTION OF DRAWINGS

Some examples of the present invention will now be described with reference to the accompanying drawings, in which:—

BRIEF DESCRIPTION OF EXAMPLES

Figure 1:
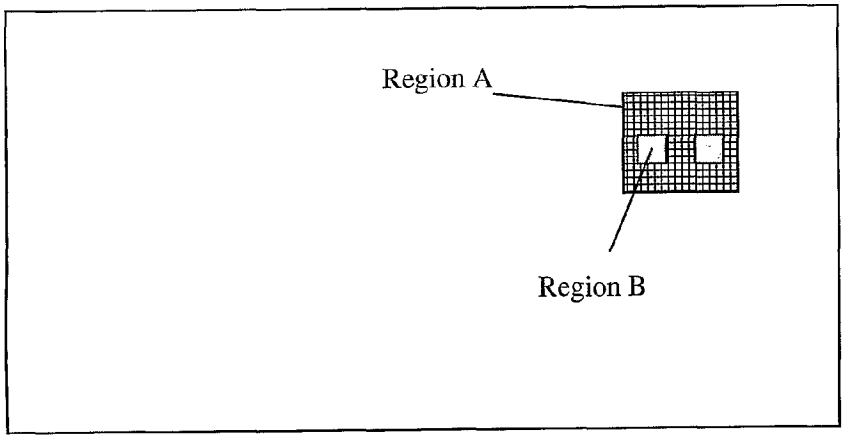
FIG. 1 shows a first example of a security document in plan view.
Figure 2:
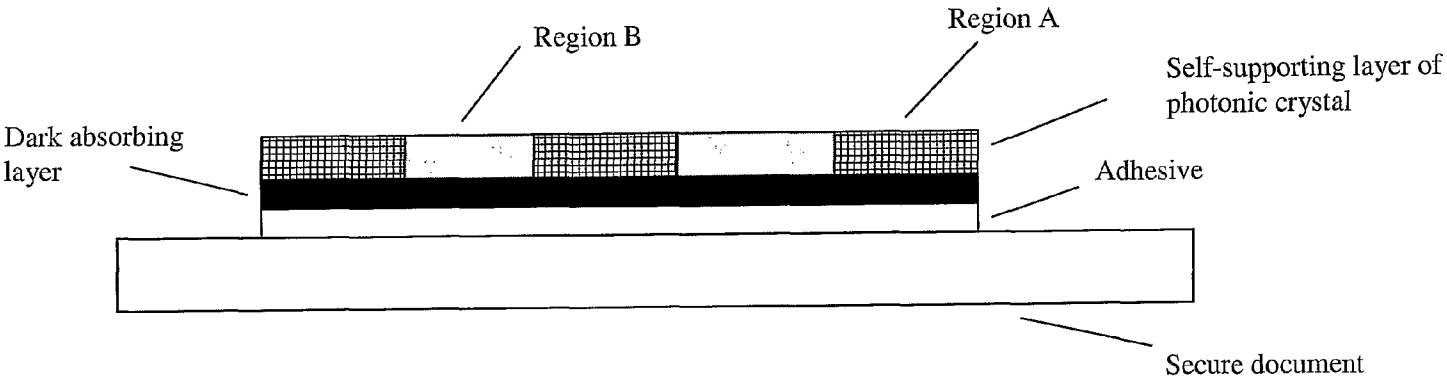
FIG. 2 shows the first example in section.

FIG. 1 shows the security device of the current invention incorporated into a security document, as a surface applied patch. FIG. 2 shows a cross-sectional view of the patch on the document in FIG. 1. The device comprises a self-supporting photonic crystal film comprising two Regions A and B, onto which is applied a dark absorbing layer. An adhesive layer is applied to the outer surface of the device on the dark absorbing layer to adhere it to the secure document. Regions A and B exhibit different angular dependent colour variations in response to incident light, which in this example were created during the formation of the photonic crystal film. For example the angular dependent colourshift in Region A can be from red, when viewed at a relatively high angle of incidence, for example 70°, to the plane of substrate, to green when viewed at a more oblique angle of incidence, for example 45°, to the plane of the substrate. In contrast the angular dependent colourshift in Region B can be from green, when viewed at 70° to the plane of substrate, to blue when viewed at 45° of incidence to the plane of the substrate.

One or both of the regions A and B are preferably in the form of a design. Preferably the designs are in the form of images such as patterns, symbols and alphanumeric characters and combinations thereof. The designs can be defined by patterns comprising solid or discontinuous regions which may include for example line patterns, fine filigree line patterns, dot structures and geometric patterns. Possible characters include those from non-Roman scripts of which examples include but are not limited to, Chinese, Japanese, Sanskrit and Arabic.

Figure 3:
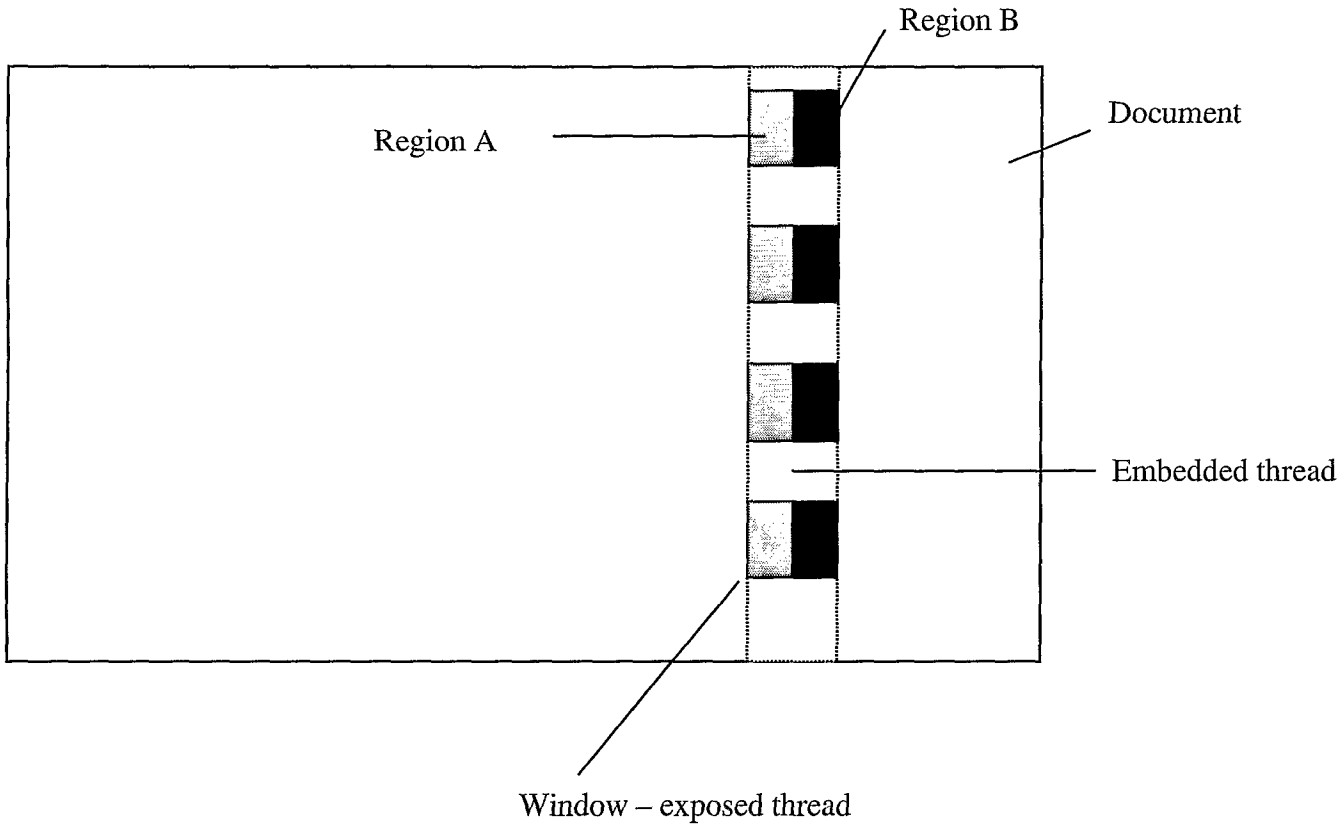
FIG. 3 shows a second example as a windowed thread.
Figure 4:
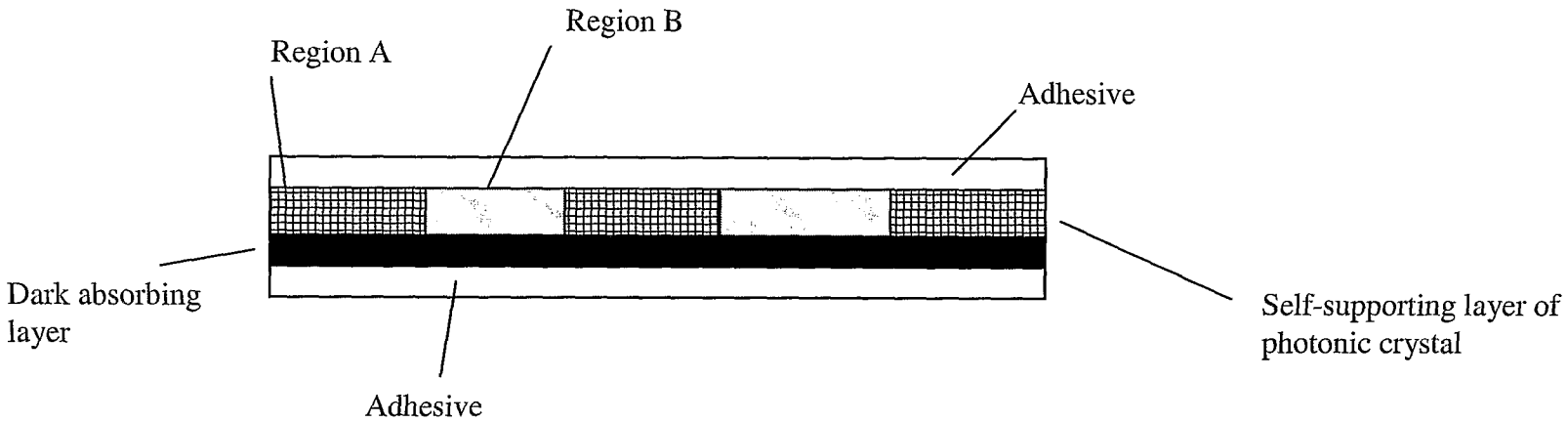
FIG. 4 shows the second example in section.

FIG. 3 shows an example security device of the current invention incorporated into a security document as a windowed thread with windows of exposed thread and areas of embedded thread. The thread comprises longitudinal bands, corresponding to Regions A and B, which exhibit different angular dependent colour variations. The bands are formed in the photonic crystal film by varying the sphere size of the polymer system during the extrusion process. FIG. 4 shows a cross-sectional view of one example of the current invention suitable for application as a windowed security thread. The device comprises a self-supporting photonic crystal film, comprising regions A and B as described for FIG. 2, onto which is applied a dark absorbing layer. An adhesive layer may be applied to the outer surfaces of the device to improve adherence to the secure document.

Figure 5:
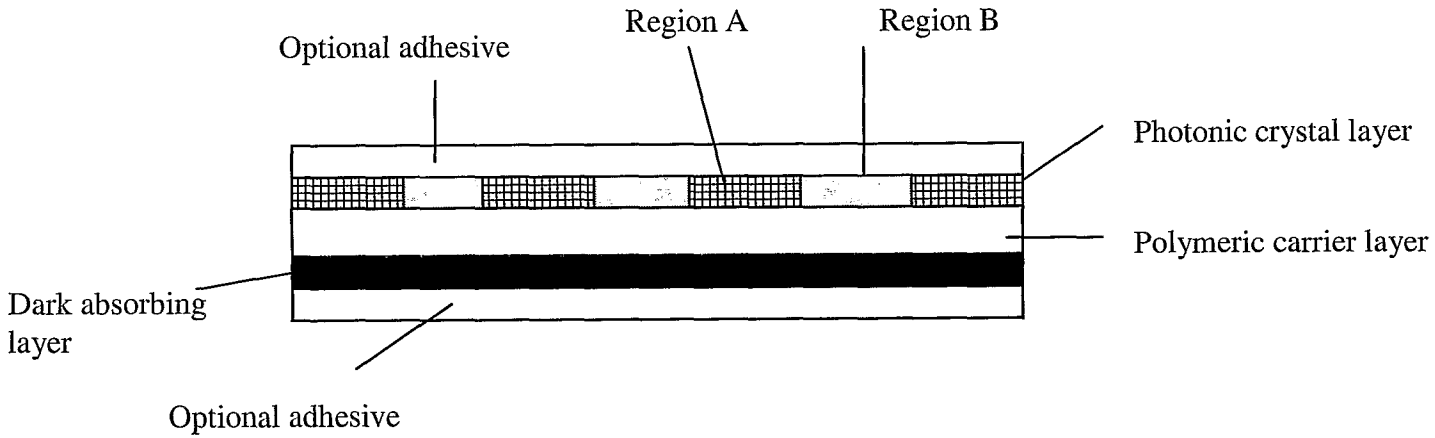
FIG. 5 shows a third example in section.

In an alternative structure to that shown in FIG. 4, and illustrated in FIG. 5, the security device comprises a polymeric carrier substrate, for example Polyethylene Terephthalate (PET) or Bi-axially Oriented Polypropylene (BOPP), onto which is applied a dark absorbing layer. A layer of photonic crystal material, comprising contrasting optically variable Regions A and B, is then applied to the opposite surface of the carrier film, or alternatively on to the dark absorbing layer. The photonic crystal layer may be formed directly onto the carrier substrate as a coated film or formed as a separate film and then laminated to the carrier substrate. The separate film can be formed as a self-supporting layer, using for example extrusion, or by coating onto a temporary carrier layer which is then discarded during the lamination process. This is particularly beneficial when the carrier substrate for the security thread comprises additional security features, such as magnetic layers and metallised layers comprising demetallised characters, which may not be suitable to be applied directly to the photonic crystal layer or which reduce the suitability of the carrier substrate to be used as a layer onto which the photonic crystal can be directly formed. An adhesive layer may be applied to the outer surfaces of the device to improve adherence to the secure document.

The fact that the security device in FIGS. 3, 4 and 5 is in the form of a windowed security thread is for illustration only and the photonic crystal could just as easily be employed as part of a surface applied security feature such as a stripe or a patch.

The examples of the current invention described in FIGS. 3 to 5 are viewed primarily in reflection and as such the optical effects of the photonic crystal material are best visualised against a dark non-selectively absorbing background. This can be achieved by placing an absorbing layer under the photonic crystal layer or by the introduction of absorbing particles into the photonic crystal materials. The absorbing particles should be significantly greater than the size of the spheres of the photonic lattice such that they do not cause a change in the lattice and consequently an undesirable change in the optical properties.

Whilst the use of a black, or very dark, substantially totally absorbing layer may give rise to the most strong colourshifts, other effects may be generated by the use of a partially absorbing layer of other colours or a combination of colours, giving rise to differing apparent colourshift colours. The absorbing layer of the current invention may comprise a pigmented ink or coating or alternatively a non-pigmented absorbing dye can be used.

It has been reported in the scientific literature, (see Optics Express, Vol. 15, No. 15, Page 9553-9561, 23 Jul. 2007), that nanoparticles can be introduced into the matrix of a photonic crystal in order to change or enhance the observed colours, colourshifts and tolerance on illumination angle.

Preferably the size of the nanoparticles is selected such that they sit within the interstitial sites of the crystal lattice. The nanoparticles enhance resonant scattering events that occur within the photonic crystal giving rise to strong structural colours. For example the incorporation of carbon nanoparticles less than 50 nm in diameter into a system comprising polystyrene spheres with a sphere size of 200 nm in a polyethlyacrylate matrix, enhances the resonant scattering of the photonic crystal and dramatically alters the appearance of the photonic crystal film from one with a weakly coloured opalescence appearance to an intensely coloured green film. The use of the nanoparticles therefore provides a key advantage in that strongly intense colours are observed without the requirement for a separate absorbing layer or the incorporation of coarse absorbing particles. Furthermore there is an increased tolerance on illumination angle such that the observed colour is no longer as dependent on the position of the light source. In a second example magnetite nanoparticles can be incorporated to generate a magnetic machine-readable colourshifting film.

The concentration of the nanoparticles may be varied across the device. For example the nanoparticles could be introduced into localised regions or there could be a gradient in the number of nanoparticles across the device. This will result in a variation in the intensity of the colour and the associated colourshift across the device.

It is preferred that the polymeric photonic crystal film is produced by an extrusion process and the nanoparticles are added to the polymer reservoir prior to extrusion. In this case laterally spaced bands of nanoparticles can be achieved by providing a set of dividers in the polymer reservoir so that the additives are supplied through the extruder at corresponding lateral positions.

The particles may be made from material which is orientable in an electric, magnetic or electromagnetic field. In this way, alignment of the particles may be affected by selective application of that specified field to the elastic photonic crystal film prior to the final cross-linking step in the film production.

Nano-photoluminescent particles such as quantum dots may be added to create a novel photoluminescence security feature. For example PbS nanoparticles can be added to produce luminescent films. It has been shown in the scientific literature (Nature Materials Volume 5 Mar. 2006 Page 179) that embedding quantum dots in a photonic crystal results in suppression of luminescence if the emission frequency falls within the band gap of the photonic crystal. If the position of the photonic band gap varies according to the direction of the incident light relative to the crystal orientation, such that it overlaps or crosses through the photoluminescence peak of the embedded emitter suppression/enhancement of emission and dynamic modification of the luminescence lifetimes may occur creating an interactive security device where the fluorescence or phosphorescence is switched on or off by simply rotating the device relative to the incident radiation.

Security devices comprising photonic crystal materials are inherently machine-readable due to the wavelength selectivity of the photonic crystal materials. In further examples the machine readable-aspect of the current invention can be extended further by the introduction of detectable materials in the photonic crystal or by the introduction of separate machine-readable layers. Detectable materials that react to an external stimulus include but are not limited to fluorescent, phosphorescent, infrared absorbing, thermochromic, photochromic, magnetic, electrochromic, conductive and piezochromic materials.

In one preferred embodiment, the pigment in the separate absorbing layers is machine-readable, for example carbon black, to produce a machine-readable, conducting or IR absorbing layer. Alternatively it may be a magnetic material, such as magnetite, to produce a machine-readable magnetic layer.

The security device of the current invention could be used in combination with existing approaches for the manufacture of security thread. Examples of suitable methods and constructions that can be used include, but are not limited to, those cited within WO03061980, EP0516790, WO9825236, and WO9928852.

Figure 6A:
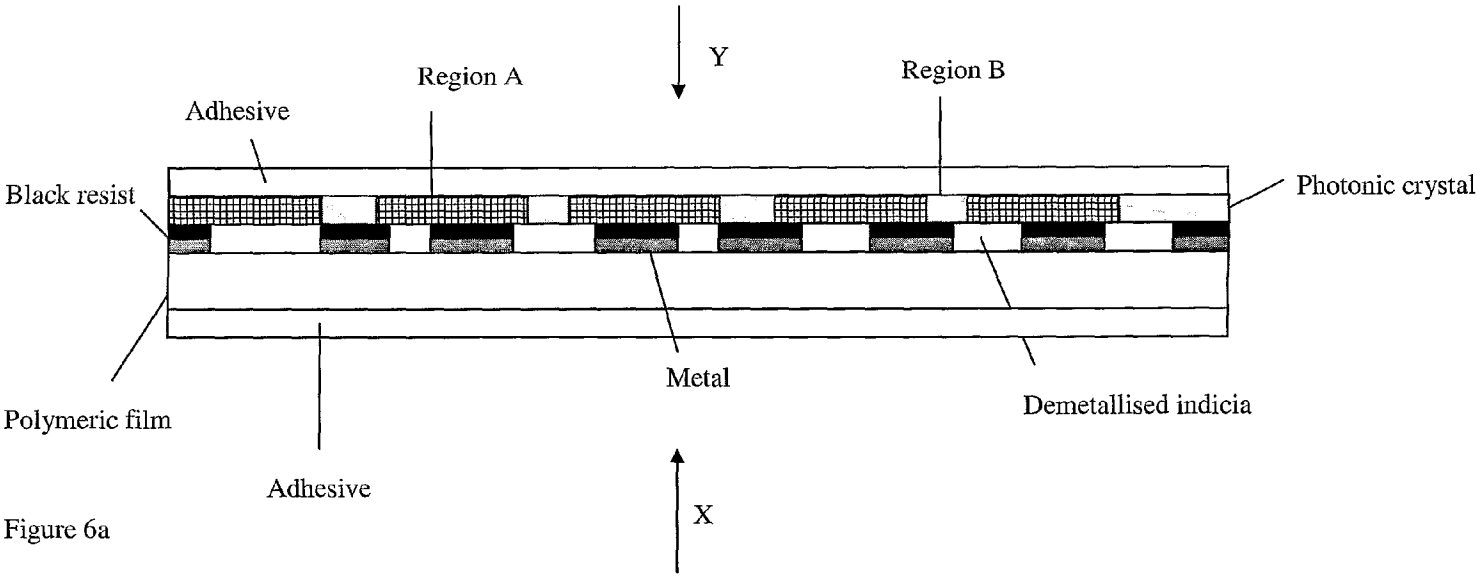
FIG. 6*a* shows a fourth example including demetalised characters.

FIG. 6*a* illustrates how the current invention can be combined with demetallised characters for application as a windowed security thread. The method requires a metallised film comprising a substantially clear polymeric film of PET or the like, which has an opaque layer of metal on a first side thereof. A suitable pre-metallised film is metallised MELINEX S film from DuPont of preferably 19 μm thickness. The metal layer is printed with a resist which contains a black or dark dye or pigment. Suitable resists include the dye BASE Neozapon X51 or the pigment (well dispersed) "Carbon Black 7" mixed into a material with both good adhesion to metal and caustic resistance.

The printed metallised film is then partially demetallised, according to a known demetallisation process using a caustic wash which removes the metal in the regions not printed with the resist. The remaining regions coated with resist provide a black layer which is visible when the demetallised film is viewed from its first side (along arrow Y) interspersed with clear regions. The shiny metal of the remaining parts of the metallic layer are only visible from an opposite side of the demetallised film (along arrow X). The resist may be printed in the form of the indicia such as words, numerals, patterns and the like; in which case the resulting indicia will be positively metallised, with the metal still covered by the dark or black resist. Alternatively the resist may be printed so as to form indicia negatively, in which case the resulting indicia will be provided by the demetallised regions. The indicia however formed, are clearly visible from both sides, especially in transmitted light, due to the contrast between the regions of the metal which have been removed and the remaining opaque regions. The photonic crystal layer is then applied, preferably using a transfer process, as with reference to FIG. 5.

The security device illustrated in FIG. 6*a* exhibits two visually contrasting security characteristics. The device comprises the optical effects of the photonic crystal layer, as described for the previous examples, when the finished substrate is viewed in reflection from the first side (along arrow Y); and a metallic shiny partial coating when viewed from the other side (along arrow X). Additionally clear positive or negative indicia, defined by the black resist, can be seen in transmission from either side. This example is particularly advantageous when used in a device that is viewable from both side of the document in which it is incorporated. For example the device could be incorporated into a secure document using the methods described in EP1141480 or WO03054297.

Figure 6B:
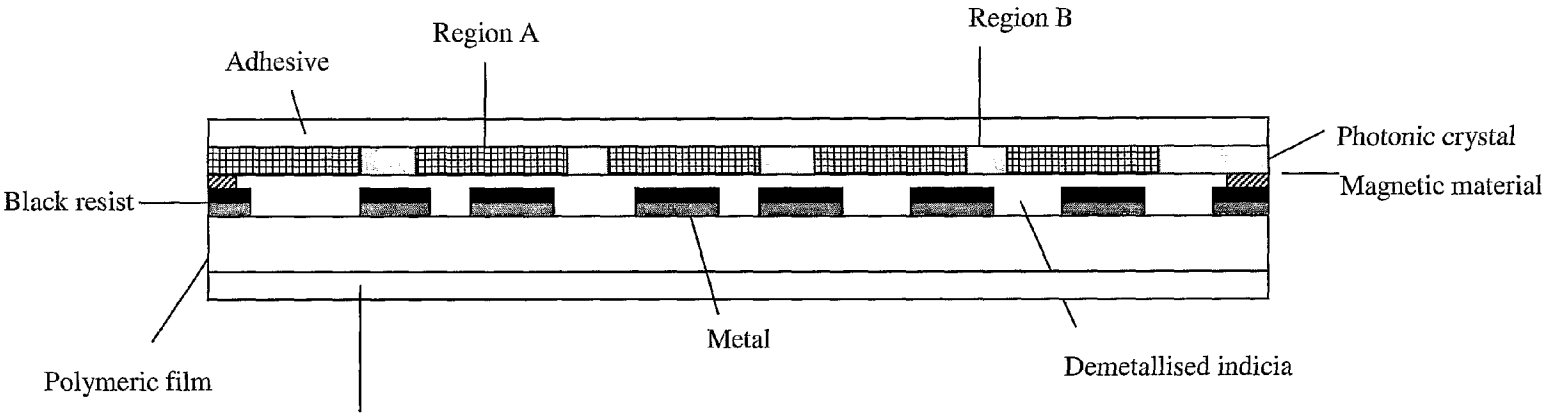
FIG. 6*b* shows a machine-readable version of the fifth example.

FIG. 6*b* illustrates a machine-readable version of the device illustrated in FIG. 6*a*. The device comprises a metallised PET base layer demetallised with a suitable design including tramlines of metal left along each edge of the device. As described with reference to FIG. 6*a* a black resist is used during the demetallisation process. A protective layer may be applied onto the metal tramlines (not shown in the Figure) to prevent the metal from being corroded by the magnetic layer, which is applied next. A suitable protective layer is VHL31534 supplied by Sun Chemical applied with coat weight of 2 gsm. The protective layer may optionally be pigmented. The magnetic material is only applied over the metal tramlines so as not to obscure the demetallised indicia. The photonic crystal layer is then applied, preferably using a transfer process, as with reference to FIG. 5. An adhesive layer may be applied to the outer surfaces of the device to improve adherence to the security document.

When a magnetic material is incorporated into the device either within the absorbing layer or as a separate layer the magnetic material can be applied in any design but common examples include the use of magnetic tramlines or the use of magnetic blocks to form a coded structure. Suitable magnetic materials include iron oxide pigments ($Fe_2O_3$ or $Fe_3O_4$), barium or strontium ferrites, iron, nickel, cobalt and alloys of these. In this context the term "alloy" includes materials such as Nickel:Cobalt, Iron:Aluminium:Nickel:Cobalt and the like. Flake Nickel materials can be used; in addition Iron flake materials are suitable. Typical nickel flakes have lateral dimensions in the range 5-50 microns and a thickness less than 2 microns. Typical iron flakes have lateral dimensions in the range 10-30 microns and a thickness less than 2 microns.

In an alternative machine-readable embodiment a transparent magnetic layer can be incorporated at any position within the device structure. Suitable transparent magnetic layers containing a distribution of particles of a magnetic material of a size and distributed in a concentration at which the magnetic layer remains transparent are described in WO03091953 and WO03091952.

In a further example the security device of the current invention may be incorporated in a security document such that the device is incorporated in a transparent region of the document. The security document may have a substrate formed from any conventional material including paper and polymer. Techniques are known in the art for forming transparent regions in each of these types of substrate. For example, WO8300659 describes a polymer banknote formed from a transparent substrate comprising an opacifying coating on both sides of the substrate. The opacifying coating is omitted in localised regions on both sides of the substrate to form a transparent region.

EP1141480 describes a method of making a transparent region in a paper substrate. Other methods for forming transparent regions in paper substrates are described in EP0723501, EP0724519, EP1398174 and WO03054297.

Figure 7:
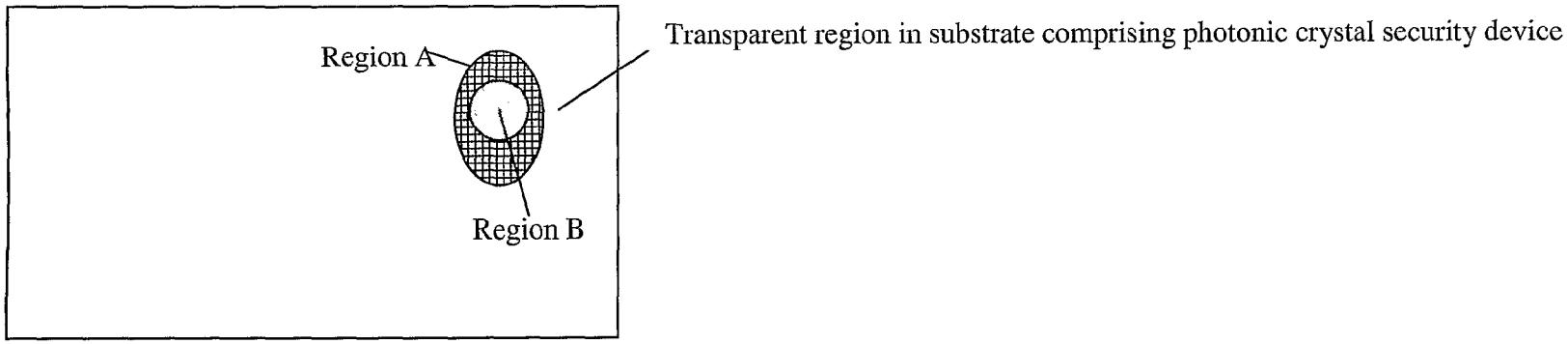
FIG. 7 shows a sixth example having a transparent region.
Figure 8A:
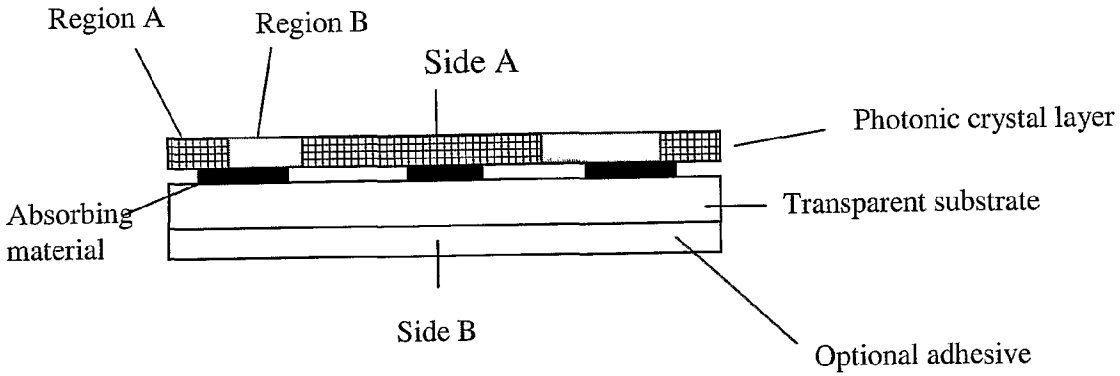
FIG. 8*a* shows a seventh example in section.

FIG. 7 shows the security device of the current invention incorporated into a transparent region of a security document. FIG. 8*a* shows a cross-sectional view of the security device within the transparent region. The security device comprises a transparent carrier layer, which preferably forms the transparent region of the substrate. An absorbing material is applied to the transparent layer in localised regions to form a recognisable pattern or identifying image. A layer comprising a photonic crystal material, comprising two Regions A and B, exhibiting the same optical characteristics as the Regions A and B in FIGS. 3 and 4, is located above the absorbing layer.

When the device in FIG. 7 is viewed in reflection from side A, two different highly contrasting coloursHifting regions are observed in Regions A and B, from the areas of the photonic crystal layer located above the absorbing layer, as the device is tilted. For example in Region A the coloursHift can be from red, when viewed at one angle of incidence to the plane of substrate, to green when viewed at a more oblique angle of incidence to the plane of the substrate. In Region B a different coloursHift will apply, over the same angular range, for example green to blue. In the regions not above the absorbing layer the transmitted colour saturates the reflective colour. The transmitted and reflected colours are complementary, for example, a red to green coloursHift in reflection is seen as a cyan to magenta coloursHift in transmission.

Figure 8B:
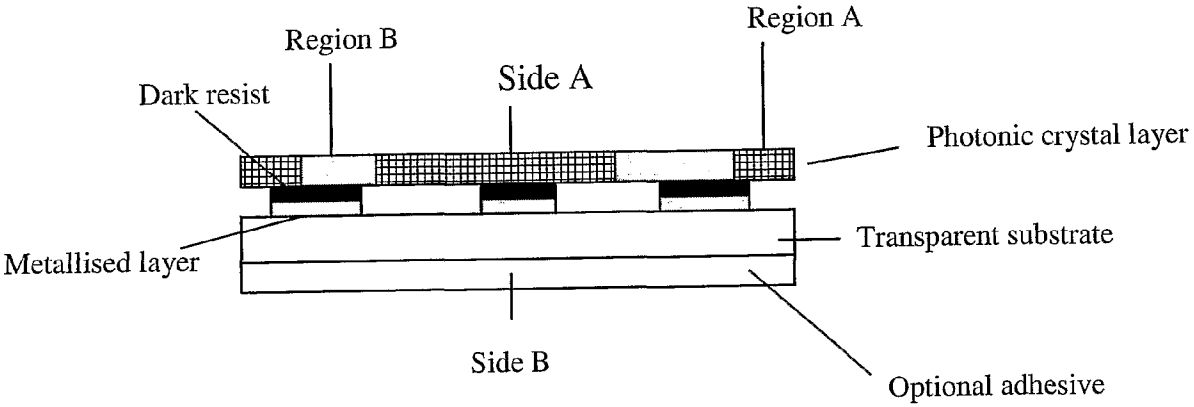
FIG. 8*b* shows a machine-readable version of the seventh example.

When the device in FIG. 8*a* is viewed in reflection or transmission from side B the dark absorbing layer will be visible in the form of an identifying image. If a dark image is not aesthetically acceptable then a more aesthetically pleasing material/colour could be used to conceal the dark resist such that it is not viewable from side B. For example the dark absorbing areas could be overprinted on side B of the transparent region with differently coloured opaque inks or metallic inks. Alternatively the transparent carrier substrate could be replaced with a metallised polymeric substrate, as illustrated in FIG. 8*b*. The metallised substrate is printed with a dark resist, as discussed in reference to FIG. 6, in the form of the identifying image. The printed metallised film is then partially demetallised removing the metal in the regions not printed with the resist. When viewing from side A the photonic crystal film is viewed against the absorbing dark resist and appears as described with reference to FIG. 8*a*, but when viewing from side B a metallic image is observed of the identifying image printed with the dark resist. The image could be positive, i.e. defined by the metallic regions, or negative, i.e. defined by the transparent regions between the metallic regions.

In an alternative machine-readable construction the dark resist in FIG. 8*b* can be formed using a magnetic pigment, for example magnetite to provide a machine-readable code. In a further embodiment, only part of the dark resist is provided with a magnetic pigment and the remainder is provided with a non-magnetic pigment. If both the magnetic and non-magnetic regions are substantially totally absorbing there will be no visual difference in the photonic crystal film over the two regions and therefore the format of the code will not be readily apparent.

Figure 9:
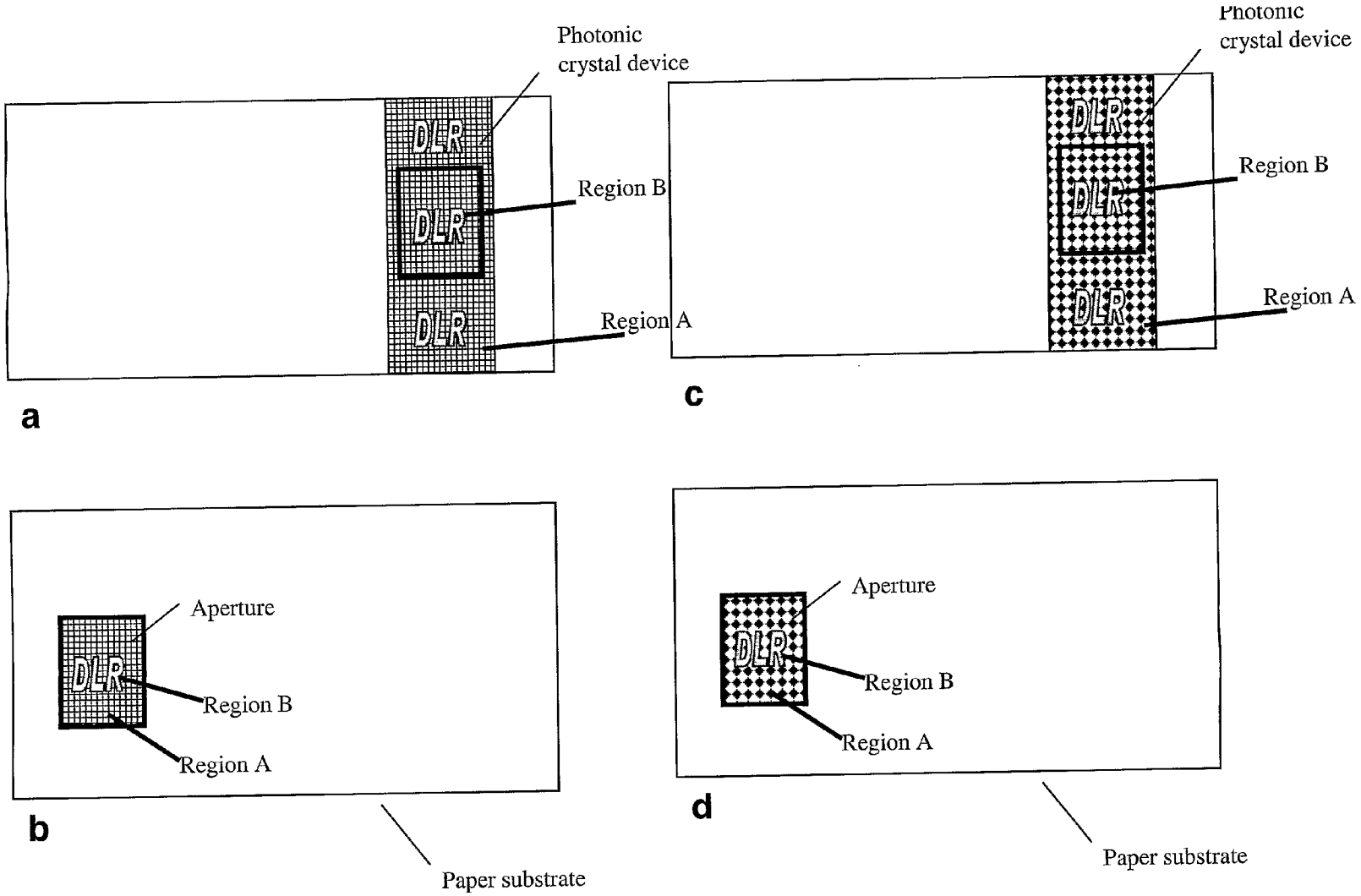
FIGS. 9*a* to 9*d* show an eighth example having an aperture in a paper substrate when viewed from different angles.

FIG. 9 illustrates an example where the security device of the current invention is incorporated into an aperture of a paper substrate. A self-supporting photonic crystal film is incorporated into a paper substrate as described in EP1141480. One side of the photonic crystal film is wholly exposed on the front surface of a paper substrate in which it is partially embedded (FIGS. 9*a* and 9*c*), and partially exposed in one aperture on the rear surface of the substrate (FIGS. 9*b* and 9*d*). In this example carbon nanoparticles have been incorporated into the photonic crystal structure.

The photonic crystal film comprises two regions A and B which were created during the formation of the film. Region A appears red when viewed at one angle of incidence to the plane of the substrate and shifts to green when viewed at a more oblique angle of incidence to the plane of the substrate. Region B is a non-opalescent region due to an area of disorder in the photonic crystal structure and its appearance remains constant at any viewing angle. In this example Region A forms the background and Region B forms the identifying image "DLR".

On viewing the device at one angle of incidence to the plane of substrate, for example 70°, Region A appears red and the non-opalescent identifying image "DLR" is visible against the red background (FIGS. 9*a* and 9*b*). On tilting to a more oblique angle of incidence, for e.g. 45°, the colour of Region A shifts from red to green but the appearance of Region B remains the same and therefore the identifying image "DLR" is visible against the green background (FIGS. 9*c* and 9*d*). This effect is visible from both sides of the security document.

The incorporation of the nanoparticles produces a single layer, i.e. non-laminate, strongly coloured substantially opaque film. This is an advantage over liquid crystal coloursHifting films where the use of a separate black or dark absorbing layer is required to generate a strongly coloured substantially opaque film. If a liquid crystal based device is used in the example shown in FIG. 9*a* then in order for the reflective coloursHifting effect to be visible from both sides of the document two liquid crystal films would be required with an absorbing layer between them. In contrast for the current invention the use of the self-supporting photonic crystal film doped with carbon nanoparticles enables the reflective coloursfhifting effect to be visible from both sides of the document while using just a single layer of coloursfhifting material. On viewing the device from the rear of the document in reflection, illustrated in FIG. 9*b*, the same optical properties in Regions A and B, as is observed from the front of the document, is present where the photonic crystal film is exposed in the aperture.

In an alternative embodiment to that referenced in FIG. 9 the photonic crystal film can be supported by a carrier layer to facilitate its incorporation into the paper document. The photonic crystal layer may be formed directly onto the carrier substrate as a coated film or formed as a separate film and then laminated to the carrier substrate. The carrier substrate may comprise additional security features including de-metallised designs, holographic designs in combination with a highly reflective layer such as a metallic layer or a thin transparent layer of a high refractive index material (for example ZnS), printed indicia, luminescent or magnetic materials, and coarse embossing with a security design that may be either blind embossed to produce a tactile/visible feature or could include printing inks to further enhance visibility. In this manner a different security feature can be observed on either side of the security device.

In a further embodiment the security device of current invention can be constructed such that different coloursfhifting effects are observed on either surface of the security device. This can be achieved by laminating together two photonic crystal films with different optical characteristics or by varying the optical characteristics of the photonic crystal film over the thickness of the film.

Different coloursfhifting effects on either surface of the security device can also be generated using a single layer of photonic crystal film by locally varying the optical characteristics of the photonic crystal film over the thickness of the film. For example the sphere size can be varied through the thickness of the film. This variation can be introduced by controlling the assembly of the spheres during the formation of the photonic crystal film. Alternatively if the film is manufactured by polymer extrusion then two polymer mixes, comprising the spheres and the matrix, can be generated with different sphere sizes. The two polymer mixes can then be co-extruded into a single polymer film forming a crystal structure where there is a step change in sphere size at an interface in the centre of the film. In addition to different coloursfhifting effects across the thickness of the film, non-opalescent regions across the thickness of the film can be created for example by varying the sphere size or controlling the process parameters such as the temperature or pressure during the application of the mechanical shear force.

Regions with different optical characteristics across the film are particularly useful for inclusion in thicker security devices (>100 μm) which might be employed as layers in card based documents such as a credit cards, debit cards, identity cards and driving licences. In these thicker structures the variations in optical properties across the thickness can be seen by viewing the cards edge-on with the naked eye. For example the polymer photonic crystal film is formed by a flat film extrusion process such that the ordering of the photonic crystal is non-optimal and a non-opalescent effect is observed. One or both surfaces of the polymer photonic crystal film then undergoes further mechanical force, in the form of a shear force, at increased temperatures to enhance the ordering and create an opalescent effect in the thickness of the film close to the surface(s) experiencing the mechanical force. In this manner a photonic crystal film can be created where the thickness of the film comprises opalescent regions close to the surface and non-opalescent regions in the centre of the film.

The security device of the current invention may be further customised in order to increase the difficulty in counterfeiting and/or provide identifying information. The customisation process can take place before or after the device is incorporated into the document. In one example the customisation of the security device occurs by applying printed information to the photonic crystal film. The photonic crystal film may be printed with images using any of the conventional printing processes such as intaglio, gravure, ink jet, offset lithography, screen, dye diffusion and flexography. The print may be applied as a single print working in a single colour or as multiple print workings in multiple colours.

In a preferred embodiment the images are printed partly on the photonic crystal film and partly on the substrate the device is incorporated into such that the design continues uninterrupted between the two surfaces. In a further embodiment, one of the colours of the printed images matches one of the switching colours of the photonic crystal film. For example if one of the regions of the photonic crystal film switches from red to green on tilting the device in a specific viewing direction then any red printed information over this region will be substantially invisible at certain angles of incidence but becomes visible as the sample is tilted and the static red of the printed information contrasts with the green of the optically variable photonic crystal film. In this manner a latent image security feature can be created.

As an alternative to the printing of ordinary coloured inks, it is also possible to print functional inks. By functional inks we mean inks that react to an external stimulus. Inks of this type include but are not limited to fluorescent, phosphorescent, infrared absorbing, thermochromic, photochromic, magnetic, electrochromic, conductive and piezochromic.

As well as functional inks, it is also possible to print onto the photonic crystal film with other optical effect inks. Optical effect inks include OVI® and Oasis® marketed by Sicpa. Other optical inks include inks containing iridescent, iriodine, pearlescent, liquid crystal and metal-based pigments.

Figure 10:
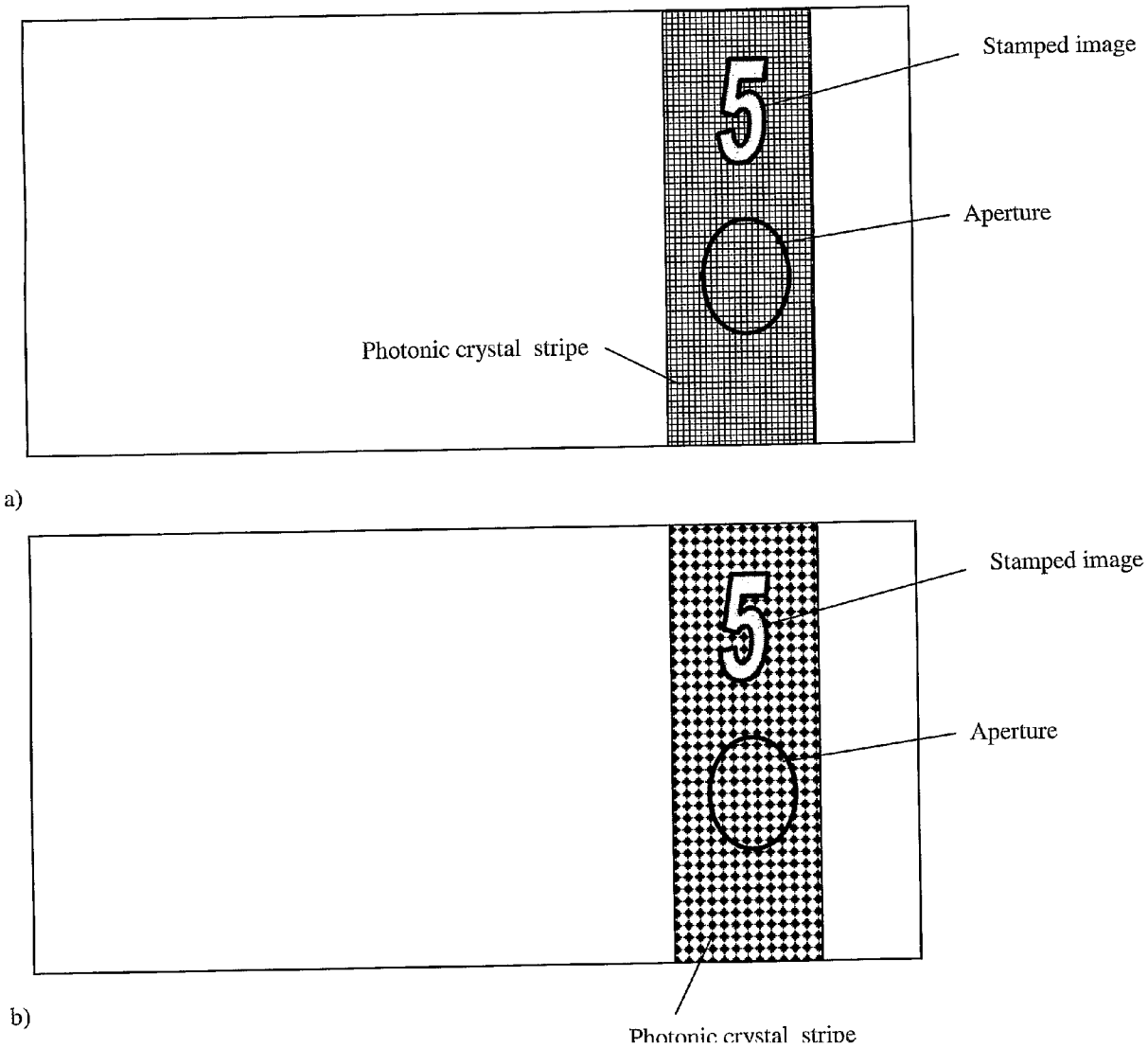
FIGS. 10*a* and 10*b* show a ninth example using hot stamped regions when viewed from different angles.

In a further embodiment non-opalescent regions are created by mechanically deforming the photonic crystal film. The mechanical deformation is preferably carried out using an embossing or hot stamping process. Preferably the embossing process takes place during the intaglio printing process and is carried out using an intaglio plate. FIG. 10 shows an example of a security substrate comprising a security device of the current invention where the photonic crystal film has been customised by hot stamping the film after it has been applied to the base substrate. In this example the elastic photonic crystal film has been incorporated into a paper substrate in the same manner as referenced in FIG. 9 and described in EP1141480. FIG. 10 shows the front surface of the paper substrate on which the device is wholly exposed. The device is also exposed on the back surface in the aperture region. In this example the photonic crystal film exhibits a red-green coloursfhift on tilting the device to an oblique angle of incidence. An image of the numeral "5" is hot stamped into the photoinic crystal film such that the order of the photonic crystal is distorted in the stamped region. The disorder in the crystal results in the stamped regions becoming non-opalescent at all angles of view. On tilting the document the numeral "5" remains non-opaslescent but the non-stamped regions change from red (FIG. 10*a*) to green (FIG. 10*b*).

In a further embodiment, the customisation of the security device occurs by embossing the photonic crystal film with raised line structures. The embossing of raised line structures into photonic crystal films is particularly advantageous because the facets generated by the embossing result in a change in the angle of incidence of the incoming light, generating facets of differing colours due to the fact that the colour of the photonic crystal film is dependent on the angle of view. The use of a raised line structure with an photonic crystal film has two secure aspects; firstly the optically variable feature generated by the line structure and secondly the creation of localised regions exhibiting different colourshifts from the background film.

For example if the photonic crystal device exhibits a green to blue colourshift on tilting the device away from normal incidence then when viewed at normal incidence the embossed and non-embossed regions will appear green. On tilting the device the non-embossed and embossed regions will change from green to blue at different angles of view as the device is tilted.

A further advantage of using embossed raised line structures is that the structures have a raised surface that can be identified by touch. The smooth surface of the photonic crystal film further enhances the tactility of these raised structures.

The embossed line structures can take any convenient form including straight (rectilinear) or curved such as full or partial arcs of a circle or sections of a sinusoidal wave. The lines may be continuous or discontinuous and, for example, formed of dashes, dots or other shapes. By other shapes we mean the dots or dashes could have a graphical form. The line widths are typically in the range 10-500 microns, preferably 50-300 microns. Preferably, the individual lines are barely visible to the naked eye, the main visual impression being given by an array of multiple lines. The lines can define any shape or form, for example square, triangle, hexagon, star, flower or indicia such as a letter or number.

The embossed line structures are preferably formed by applying an embossing plate to the photonic crystal film under heat and pressure. Preferably the embossing process takes place during the intaglio printing process and is carried out using an intaglio plate having recesses defining the line structures. Preferably the photonic crystal film is blind embossed, i.e. the recesses are not filled with ink. However it is also possible that some of the recesses defining the embossed structure may be filled with ink and others left unfilled. Further intaglio printing or blind embossing may be carried out on regions of the substrate adjacent to the security device using the same intaglio plate so as to achieve precise registration between the different regions.

Figure 11:
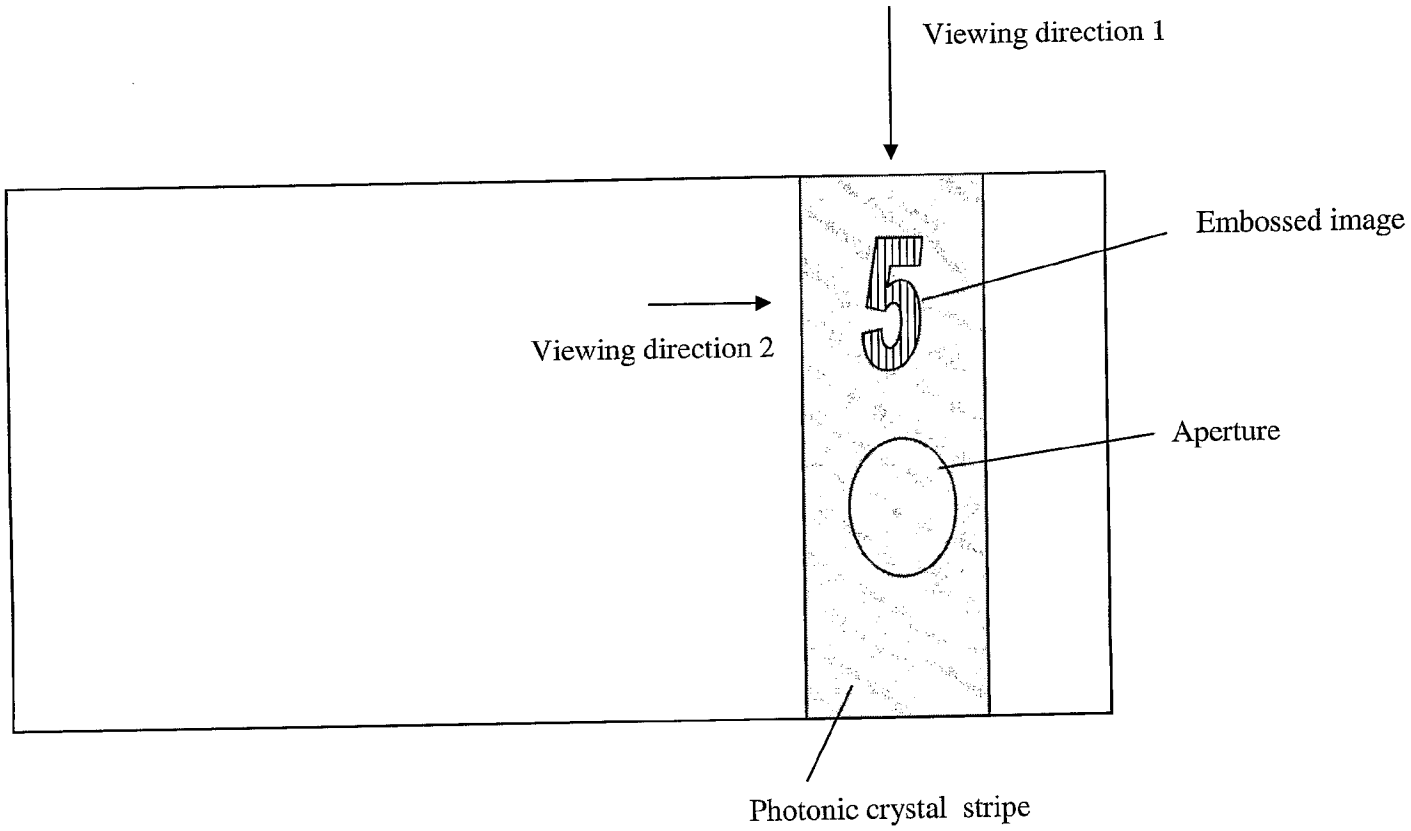
FIG. 11 shows an embossed tenth example.

FIG. 11 shows an example of a security substrate comprising a security device of the current invention where the photonic crystal film has been customised by embossing the film after it has been applied to the base substrate. In this example the elastic photonic crystal film has been incorporated into a paper substrate in the same manner as referenced in FIG. 9 and described in EP1141480. FIG. 11 shows the front surface of the paper substrate on which the device is wholly exposed. The device is also exposed on the back surface in the aperture region. In this example the photonic crystal film exhibits a red-green colourshift on tilting the device to an oblique angle of incidence and viewing along viewing direction 1 and a green-blue colourshift on tilting the device to an oblique angle of incidence and viewing along viewing direction 2. The embossed line structures, formed by a respective set of substantially parallel raised lines, define the numeral "5".

On viewing the substrate along viewing direction 1 at a relatively high angle of incidence, for example 70° to the plane of the substrate the non-embossed regions appear red but the embossed regions appear green due to the dominant reflected light arising from the edges of the raised lines. The difference in colour arises because the effective angle of incidence for light incident on the edge regions is greater than the angle of incidence for light incident on flat non-embossed regions. On tilting the substrate to a more oblique angle of incidence the non-embossed regions switch from red to green and the embossed regions switch from green to blue. If the device is rotated by 90°, such that it is viewed along viewing direction 2 the embossed and non-embossed regions appear substantially the same colour at a given viewing angle because very little light is reflected by the edge of the lines.

In a further embodiment the customisation of the security device occurs by embossing the photonic crystal film with a non-diffractive line structure. A non-diffractive line structure is an example of a raised line structure which produces an optically variable effect when the angle of incidence light varies, but in which this effect is not caused by interference or diffraction. Security devices based on non-diffractive line structures are known in the prior art for example WO9002658 describes a security device in which one or more transitory images are embossed into a reflective surface. WO9820382 discloses a further security device in which a group of elemental areas in which lines extend at different angles from each other form respective image pixels. U.S. Pat. No. 1,996,539 discloses a decorative device in which a relief structure is formed in a surface and has an optically variable effect. WO2005080089 discloses a security device which has segments defined by line structures in a reflective portion of a substrate, which cause incident light to be reflected non-diffractively as the angle of incidence changes.

In an alternative embodiment the security device further comprises an optically variable device such as a hologram or diffraction grating. These devices are commonly formed as relief structures in a substrate, which is then provided with a reflective coating to enhance the replay of the device. In the current invention the photonic crystal can act as the reflective coating and the relief structure can be embossed directly into the photonic crystal film or into an embossing lacquer applied onto the photonic crystal film. Alternatively localised regions of the device can be provided with a metallised layer and the relief structure subsequently embossed into an embossing lacquer on top of the metallised layer. In this manner the device comprises two laterally spaced regions one exhibiting the colourshifting properties of the photonic crystal film and one exhibiting the optically variable properties of a holographic device. Alternatively the metallic reflective coating can be replaced with a transparent reflection enhancing materials for example a thin layer of a high refractive index material such as ZnS. In this case both the colourshifting properties of the photonic crystal material and the optically variable properties of the holographic device are visible in all areas of the device although the optically variable properties of the holographic device will only be visible at certain angles of view.

In a further embodiment of the invention the security device can be customised by the application of a scattering layer to the photonic crystal film. In a preferred embodiment the scattering layer takes the form of a matt varnish or lacquer. In this context a matt varnish or lacquer is one that reduces the gloss of the photonic crystal film by scattering the light reflected from it. One example of a suitable matt varnish is a suspension of fine particles in an organic resin. The surface particles scatter the light as it passes through the varnish resulting in a matt appearance. A suitable varnish for the present invention is "Hi-Seal O 340" supplied by Hi-Tech Coatings Ltd. In an alternative solution the fine particles can be replaced by organic waxes. As a further alternative, the scattering layer can be generated by embossing a matt structure into the surface of a photonic crystal layer. Suitable embossed matt structures are described in WO9719821. The scattering layer modifies the colourshifting properties of the photonic crystal layer.

The scattering layer modifies the surface of the photonic crystal film such that the reflection is now more diffuse reducing the glare of the photonic crystal film and changing the angular range over which the respective colours of the security device are easily viewable to the authenticator. For example, if the photonic crystal material exhibits a red to green colourshift on tilting the device away from normal incidence then the switch from red to green occurs closer to normal incidence for the region with the scattering layer compared to one without a scattering layer.

Figure 12:
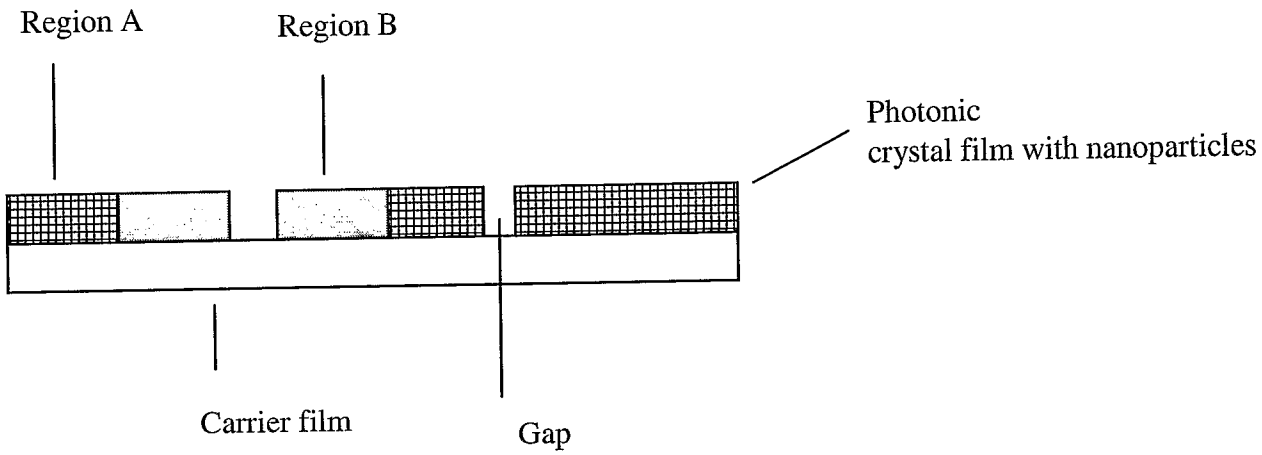
FIG. 12 shows an eleventh example in section having gaps in the photonic film.

FIG. 12 illustrates a further example where there are gaps present in the photonic crystal film. The device in FIG. 12 comprises a photonic crystal film which has been transferred onto a substantially transparent carrier substrate. Alternatively a self-supporting photonic crystal film can be used without the need for a carrier substrate. The photonic crystal film is the same as that described in relation to FIG. 9 and carbon nanoparticles have been incorporated into the photonic crystal structure to produce a substantially opaque film with an intense red colour when viewed at normal incidence. A laser is used to form gaps in the photonic crystal film in the form of an identifying image. The identifying image is clearly visible from both sides, especially in transmitted light due to the contrast between the regions of the substantially opaque photonic crystal film which have been removed and the remaining opaque regions. The security device illustrated in FIG. 16 exhibits two visually contrasting security characteristics; firstly the optical effects of the photonic crystal layer and secondly the identifying image clearly visible in transmission from either side of the device.

In yet a further embodiment of the present invention, photonic crystal materials can be selected such that at certain angles of view for at least one of the Regions the reflected light is in the non-visible wavelengths of the electromagnetic spectrum.

In all of the examples the designs or identifying images created by any of the layers, for example the photonic crystal film, the absorbing or customising layers, can take any form. Preferably the designs are in the form of images such as patterns, symbols and alphanumeric characters and combinations thereof. The designs can be defined by patterns comprising solid or discontinuous regions which may include for example line patterns, fine filigree line patterns, dot structures and geometric patterns. Possible characters include those from non-Roman scripts of which examples include but are not limited to, Chinese, Japanese, Sanskrit and Arabic.

It will further be appreciated that in each of the examples described above one of the Regions A and B may exhibit an optically variable effect whereas the other region may either exhibit an optical effect in the form of an optically variable effect or a non-optically varying effect.

We now describe some examples of methods of forming an optically variable security device. Referring to the flow diagram of FIG. 13, at step 100 a material suitable for the formation of a photonic crystal (photonic crystal material) is provided at step 100. The material in question comprises a first phase of polystyrene (PS) spheres and a matrix of polyethylacrylate (PEA) as discussed earlier. As will be appreciated, the choice of diameter of the spheres which form the ordered structure in the eventual photonic crystal, influences the colour of material under white light illumination. Typically the sphere diameter is around 250 nm. In order to ensure compatibility between the polystyrene spheres (first phase) and the matrix (second phase) the spheres are coated with a fine layer of polymethylmethacrylate (PMMA) as an interlayer. In the initial state of the material at step 100 the spheres are dispersed at random within the matrix and are therefore disordered.

At step 101, the material is then loaded into an extrusion apparatus and heated to a first temperature. The first temperature is chosen to be in excess of the glass transition temperature of the polyethylacrylate matrix and yet is below the glass transition temperature of the polystyrene. The intent is to heat the matrix so that the spheres are able to flow with respect to one another within the matrix, aided by external pressure, whereas the spheres themselves are not substantially softened and therefore maintain their shape upon later cooling. Once the material is thoroughly heated to the first temperature, then at step 102 the extrusion apparatus is operated and the material is forced through an extrusion die. The die may take a number of forms, typically having a tapering entrance leading to a narrow channel through which the material is extruded. The material impacts against the tapering surfaces and is then directed towards and passes through the narrower slot or channel. It should be noted that, optionally, the tapered surfaces or the walls of the channel may be provided with a texture to influence the local slip behaviour of the passing material. The exit of the die has a rectangular geometry in this example with the larger dimension representing the desired width of the extruded material, and the narrow dimension representing its thickness. A typical thickness in the present case is about 30 μm. Typically during the extrusion process the die is heated to a similar temperature to that of the extruded material. Upon exiting the die the material takes the form of a flexible self-supporting film. This film may be cooled by the application of air jets or by conductive contact with a surface.

It should be noted that whilst the material upstream of the die has essentially a random arrangement of spheres within the matrix, the forcing of the material through the die causes the spheres to arrange themselves into a more efficient packing formation, the most efficient possible being a completely close-packed structure. An approximately opal-like structure is formed by these spheres adopting a close-packed structure with at least short range order. The efficiency of the packing is dependent upon a number of parameters, including the temperature, the die shape and the degree of similarity between the actual dimensions of the spheres. As will be appreciated, the arrangement of the spheres causes the material to adopt an opal-like structure which, due to the sphere size and the materials used, exhibits an optically variable effect. This is indicated at step 103. It should be noted that, whilst a single extrusion die has been discussed at step 102, it is possible for multiple extrusion processes to be applied, or indeed other forms of deformation, including stamping, rolling and calendaring, in order to encourage the structure to adopt the opal-like form with a predetermined level of packing efficiency.

Regardless of how the film is formed, the opal-like form in the present example comprises at least a first region of optically variable properties. Thus the deformation process in the form of extrusion causes the production of a first region of opal-like structure with corresponding optically variable properties.

At step 104, the film is passed into a hot stamping apparatus which performs a second process upon the material, in this case the second process also comprising deformation. The hot stamping apparatus applies pressure to selected areas of the film, these areas comprising a second region. In this case the process is performed at an elevated temperature which is in excess of the glass transition temperature of the polystyrene. The temperature may even be in excess of the melting temperature of the polystyrene. A heated die, stamp or roller can be used to perform this function. The hot stamping process causes the opal-like structure in the second region to be disrupted by permanently plastically deforming or melting the spheres, causing them to amalgamate and lose their relative ordered structure. The formation of this non-opalescent second region is performed at step 105. It should be noted that a heated stamp, die or roller may be used having a geometry such that the second regions are formed according to particular indicia or indeed negative indicia (whereby indicia themselves are formed from the boundaries of the second region). In this case the second region is formed so as to overlay the first region and therefore the negative indicia may surround the first regions which form of the indicia themselves.

Having formed the first and second regions, the film is optionally cooled and, in step 106, an adhesive layer may be applied.

Following the application of adhesive, at step 107 the photonic crystal film is then adhered to a substrate material such as a banknote, credit card, passport or other document of value. At step 108 various finishing processes are performed such as further printing, laminating, cutting and processes for adding further security features.

Thus a security document is produced having a photonic crystal material with a first region exhibiting an optically variable effect, and a second region in which a second optical effect is observed, which in the present case is not optically variable. In the present case, the second region may therefore appear to have a diffuse translucent appearance which contrasts with the optically variable appearance of the first region. One of the key advantages of this is that the first and second regions are contained within the same continuous film which is more difficult to counterfeit.

One particular alternative to the hot stamping process discussed in association with step 104 is the use of a modified process in which the temperature of the hot stamp/die/roller is such that the material is heated to a temperature between the glass transition temperature of the matrix and that of the spheres themselves. This allows the spheres to remain substantially solid and yet able to move within the material matrix. Using an appropriately shaped stamp for example, such as one having a very shallow inclined surface, the spheres may be caused to partition away from parts of the material so as to form a region of only PEA matrix with substantially no spheres present. In this case the spheres are not destroyed but are rather displaced to an area around the region in question. Thus, the substantially sphere-free region and the region into which the spheres are displaced may exhibit individual and different optical effects, again providing enhanced security against counterfeiting.

In a further alternative example, the ordering of the spheres into a close-packed structure which occurs at step 102 is arranged to occur to a limited extent such that a relatively weak optically variable effect may be seen in the resultant structure at step 103. In this case a subsequent thermo-mechanical process at step 104 is arranged to be performed at a temperature between the glass transition temperature of the matrix and that of the polystyrene, for example at a similar temperature to the original extrusion. The further application of pressure during this process then causes the partially opal-like film to increase in order so as to produce a more ordered structure. In this way a second region is formed having a more strongly optically variable effect such that the first region has a relatively weak optically variable effect and the second region has a relatively strong optically variable effect. In each case the optical effect is the same as a function of angle although the strength of the colour changes in the second region is much more visible than those in the first region.

In the examples described herein, involving the use of deformation processes such as stamping and rolling where the film is deformed between two members, then it will be appreciated that these members may have a symmetrical form and apply equal deformation upon each side of the film. In other cases a first one of the members may be fixed in position with the other being arranged to moved towards the first, with the film therebetween.

Figure 13:
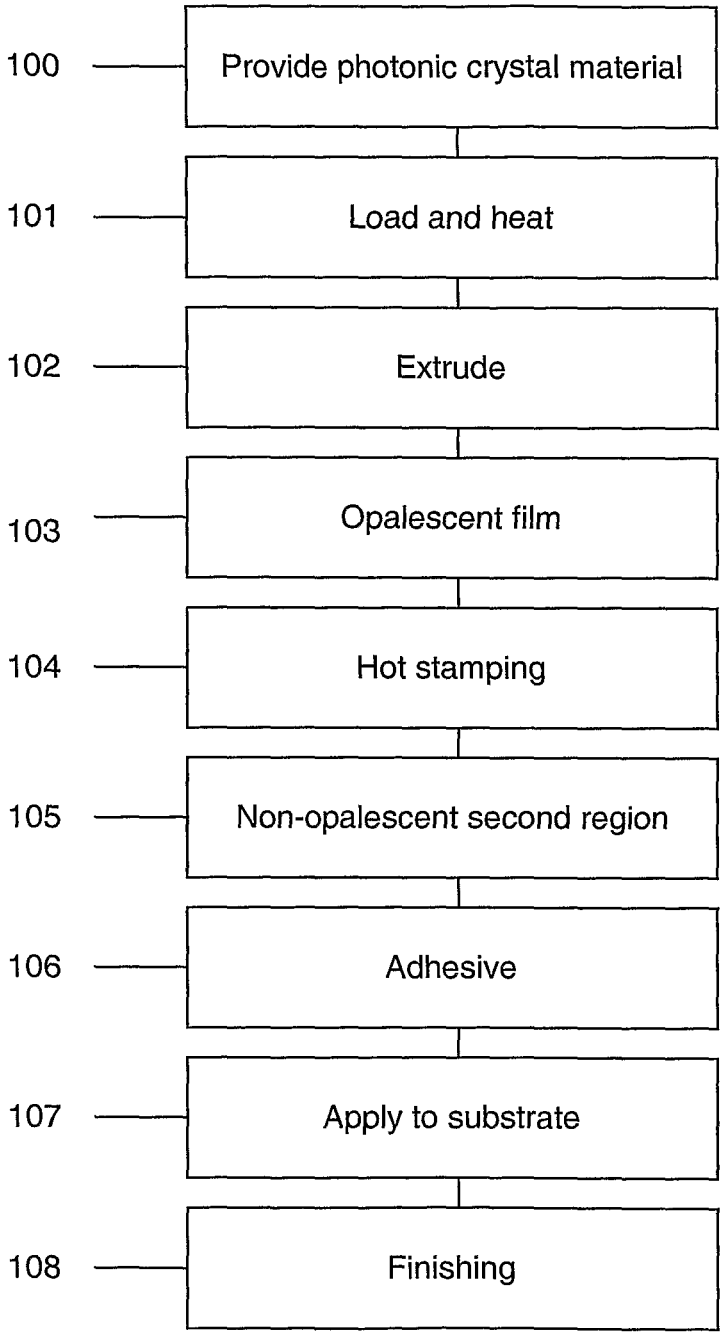
FIG. 13 shows a flow diagram of an example method of fabricating a security device.
Figure 14:
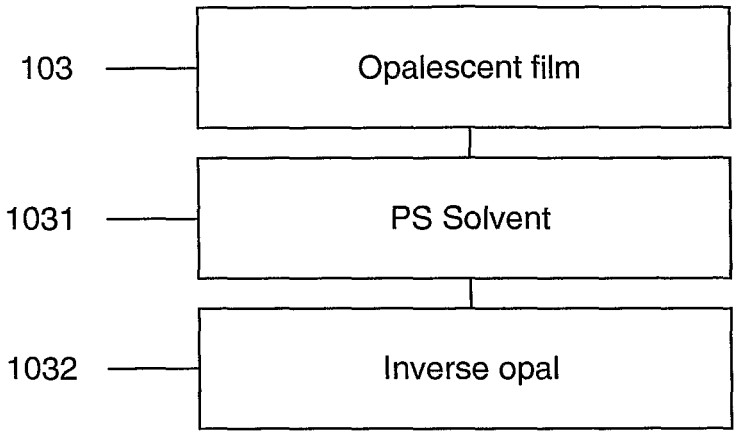
FIG. 14 shows an example method for forming an inverse opal-like structure; and, FIG. 15 shows a further alternative example method using an inverse opal-like structure.

Turning now to FIG. 14, a further alternative method is described, this comprising steps 100 to 103 similar to that of FIG. 13. In this case the processing is arranged such that a high degree of ordering is provided and an opal-like film is produced at step 103. In this example, following step 103, the film is passed into a bath of a suitable solvent material for polystyrene. An example of the suitable solvent is tetrahydrofurfuryl alcohol. Notably such a solvent is not a solvent for polyethylacrylate (the matrix). The passing of the film into a bath of solvent occurs at step 1031 and this causes the dissolution of the spheres and thereby the formation of an inverse opal structure at step 1032. Following a washing process, the process may then return to step 104 of FIG. 13 where selected areas of the inverse opal structure may be hot stamped or otherwise deformed. In this case the hot stamping removes the voids within the inverse opal structure so as to produce second regions which are non-opalescent at step 105. Whilst the whole of the film is immersed within the bath, it is envisaged that only part of the film, such as one half, might be immersed, resulting in regions which are opalescent, inverse opalescent and non-opalescent.

Figure 15:
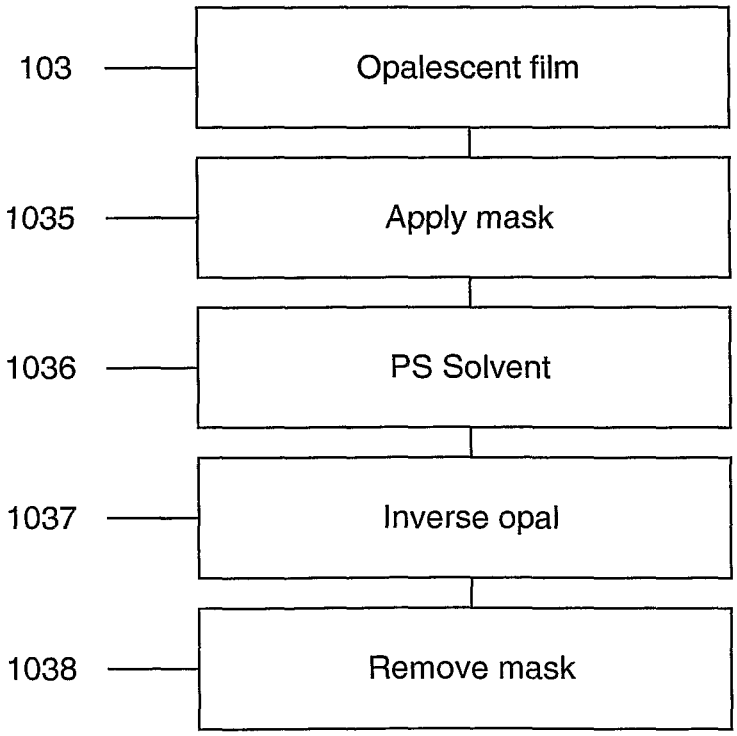

Another example process is discussed in association with FIG. 15. Again, an opal-like film is formed according to steps 100 to 103 of FIG. 13. At step 1035 the film is subjected to the deposition of an etch mask. This may be applied by one of a number of processes including photolithography or printing. Typically the mask is applied to selected regions of the film so as to leave further regions exposed.

At step 1036, a solvent for polystyrene is applied to the film. Whilst this could be achieved as described above by the use of a bath of solvent, in the present case the solvent is applied by the use of a printing process, with solvent being applied for example using rollers or printing plates. The solvent may be applied to both the exposed and masked regions and, due to the presence of the mask, only effect the dissolution of the polystyrene spheres in the exposed regions, the mask thereby protecting the material beneath. As an alternative, the solvent could be selectively printed onto certain regions of the film, thereby potentially obviating the need for the mask. Furthermore a mask could nevertheless be used so as to ensure no contamination of certain masked regions by the solvent. At step 1037 an inverse opal structure is provided selectively in the exposed regions and the mask may then be removed in a subsequent step 1038. The resultant material therefore has a first region comprising an opal-like structure containing polystyrene spheres, and a second region having an inverse opal-like structure with the spheres removed. Due to the different refractive indices between polystyrene and the voids, a first optically variable effect is seen in association with the first region and a second optically variable effect, which is different from the first, is seen in the second region where the inverse opal-like structure is present.

The process of FIG. 15 then returns to that of FIG. 13 whereby it is possible for the further steps 104 and 105 to be omitted, the next step therefore being 106 in which adhesive is applied and the remaining steps are performed as described in association with FIG. 13. However, it may be desirable to perform a further thermo-mechanical process according to step 104 and step 105 upon either of the opalescent or inverse opalescent regions so as to either fully convert one of these regions into a non-opalescent region or to provide a third region which is non-opalescent.

Whilst the above examples in association with FIGS. 13 to 15 have been discussed with the use of an adhesive so as to bond the device to a document of value, it will be appreciated that a film produced according to these processes could be incorporated into a document of value such as a banknote by a process similar to the formation of a windowed thread using watermarking techniques.

The invention claimed is:

1. An optically variable security device comprising at least a first region and a second region that each region comprises a photonic crystal material, whereby:

in the first region the photonic crystal material is configured such that incident light received by the photonic crystal material is selectively reflected or transmitted by the photonic crystal material to generate a first optically variable effect when illuminated and viewed under a predetermined set of conditions; and in the second region the photonic crystal material is configured such that incident light received by the photonic crystal material is reflected or transmitted by the photonic crystal material to generate a second optical effect different from the first optically variable effect when illuminated and viewed under the same said predetermined set of conditions, wherein:

each of the first and second regions has a respective degree of crystal ordering; and the degree of crystal ordering of the second region that generates the second optical effect is greater than or less than the degree of crystal ordering of the first region that generates the first optically variable effect.

2. The optically variable security device according to claim 1, wherein the photonic crystal material has a full or partial band gap that does not have rotational symmetry about a normal to its surface.

3. The optically variable security device according to claim 1, wherein:

the first optically variable effect is observable over a first set of directions; and the optical effect is observable over a second set of directions and is a second optically variable effect.

4. The optically variable security device according to claim 3, comprising a photonic crystal in which the said first and second optically variable effects are dependent upon a crystal orientation with respect to the incident light.

5. The optically variable security device according to claim 1, wherein part of one or more of the optical effects is in an infra-red or ultra-violet part of an electromagnetic spectrum.

6. The optically variable security device according to claim 1, wherein:

the first optically variable effect is a first angularly dependent colour effect; and the second optically variable effect is a second angularly dependent colour effect, which is different from the first angularly dependent colour effect.

7. The optically variable security device according to claim 1, wherein the photonic crystal material is formed from spheres of a first material and a matrix of a second material, each material having a different respective refractive index.

8. The optically variable security device according to claim 1, wherein the first and second regions are formed from spheres of substantially the same material, the material of each region having differing respective sphere dimensions.

9. The optically variable security device according to claim 1, wherein photonic crystal structural parameters are different within the first and the second regions of the photonic crystal material so as to produce different corresponding optical properties.

10. The optically variable security device according to claim 1, wherein the second region exhibits a non-opalescent effect.

11. The optically variable security device according to claim 10, wherein the second region comprises a substantially disordered structure.

12. The optically variable security device according to claim 1, wherein one of the first region or second region comprises an opal structure.

13. The optically variable security device according to claim 1, wherein one of the first region or second region comprises an inverse opal structure.

14. The optically variable security device according to claim 1, wherein:

one of the first region and second region comprises an opal structure; and the other of the first region and second region comprises an inverse opal structure.

15. The optically variable security device according to claim 1, wherein the device further comprises a metallised layer.

16. The optically variable security device according to claim 1, wherein the device is arranged to be machine-readable.

17. The optically variable security device according to claim 1, wherein:

the device is formed from a number of different layers; and the device is adapted to be planar and is adapted to be observed from first and second opposing sides.

18. The optically variable security device according to claim 17, wherein at least part of one or each of the first and second regions of the photonic crystal material are observable from the first and second opposing sides.

19. The optically variable security device according to claim 1, wherein a surface of the photonic crystal material is embossed with raised structures.

20. The optically variable security device according to claim 1, wherein a surface of the photonic crystal device is overprinted.

21. The optically variable security device according to claim 20, wherein the device is arranged to produce a latent image that is selectively visible according to a viewing angle.

22. The optically variable security device according to claim 1, wherein the photonic crystal material is provided as a polymeric film.

23. A security document comprising a security device according to claim 1, wherein the security device is adhered to or contained within the security document.

24. The security document according to claim 23, wherein the device is embedded within a document window so as to provide crystal surfaces for receiving incident light on each of opposing faces of the document.

25. The security document according to claim 23, wherein the security device is provided in a form selected from the group consisting of a security thread, a security fibre, a security patch, a security strip, a security stripe, and a security foil.

26. The security document according to claim 23, wherein the security document is a bank note, driving licence, passport, identity card, credit or debit payment card, fiscal stamp, cheque, postal stamp, certificate of authenticity, brand protection article, bond, or payment voucher.

27. An optically variable security device comprising at least a first region and a second region that each region comprises a photonic crystal material, whereby:

in the first region the photonic crystal material is configured such that incident light received by the photonic crystal material is selectively reflected or transmitted by the photonic crystal material to generate a first optically variable effect when illuminated and viewed under a predetermined set of conditions; and in the second region the photonic crystal material is configured such that incident light received by the photonic crystal material is reflected or transmitted by the photonic crystal material to generate an optical effect, different from the first optically variable effect when illuminated and viewed under the same said predetermined set of conditions, wherein:

one of the first region and the second region comprises an opal structure having a respective degree of crystal ordering; and the other of the first region and the second region comprises an inverse opal structure in which the degree of crystal ordering is greater than or less than the degree of crystal ordering of the region comprising the opal structure.

28. The optically variable security device according to claim 27, wherein the photonic crystal material has a full or partial band gap that does not have rotational symmetry about a normal to its surface.

29. The optically variable security device according to claim 27, wherein:

the first optically variable effect is observable over a first set of directions; and the optical effect is observable over a second set of directions and is a second optically variable effect.

30. The optically variable security device according to claim 29, comprising a photonic crystal in which the said first and second optically variable effects are dependent upon a crystal orientation with respect to the incident light.

31. The optically variable security device according to claim 27, wherein part of one or more of the optical effects is in an infra-red or ultra-violet part of an electromagnetic spectrum.

32. The optically variable security device according to claim 27, wherein:

the first optically variable effect is a first angularly dependent colour effect; and the second optically variable effect is a second angularly dependent colour effect, which is different from the first angularly dependent colour effect.

33. The optically variable security device according to claim 27, wherein the first and second regions are formed from spheres of the same material, the material of each region having differing respective sphere dimensions.

34. The optically variable security device according to claim 27, wherein photonic crystal material structural parameters are different within the first and the second regions of the photonic crystal material so as to produce different corresponding optical properties.

35. The optically variable security device according to claim 27, wherein:

each of the first and the second regions has a respective degree of crystal ordering; and the degree of ordering of the second region is greater than that of the first region.

36. The optically variable security device according to claim 27, wherein the device further comprises a metallised layer.

37. The optically variable security device according to claim 27, wherein the device is arranged to be machine-readable.

38. The optically variable security device according to claim 27, wherein:

the device is formed from a number of different layers; and the device is adapted to be substantially planar and is adapted to be observed from first and second opposing sides.

39. The optically variable security device according to claim 38, wherein at least part of one or each of the first and second regions of the photonic crystal material are observable from the first and second opposing sides.

40. The optically variable security device according to claim 27, wherein a surface of the photonic crystal material is embossed with raised structures.

41. The optically variable security device according to claim 27, wherein a surface of the photonic crystal device is overprinted.

42. The optically variable security device according to claim 41, wherein the device is arranged to produce a latent image which is selectively visible according to a viewing angle.

43. The optically variable security device according to claim 27, wherein the photonic crystal is provided as a polymeric film.

44. A security document comprising a security device according to claim 27, wherein the security device is adhered to or contained within the security document.

45. The security document according to claim 44, wherein the device is embedded within a document window so as to provide crystal surfaces for receiving incident light on each of opposing faces of the document.

46. The security document according to claim 44, wherein the security device is provided in a form selected from the group consisting of a security thread, a security fibre, a security patch, a security strip, a security stripe, and a security foil.

47. The security document according to claim 44, wherein the security document is a bank note, driving licence, passport, identity card, credit or debit payment card, fiscal stamp, cheque, postal stamp, certificate of authenticity, brand protection article, bond, or payment voucher.

* * * * *